US008834285B2

(12) United States Patent
Franklin et al.

(10) Patent No.: US 8,834,285 B2
(45) **Date of Patent: *Sep. 16, 2014**

(54) PUTTER HEADS AND PUTTERS

(75) Inventors: David N. Franklin, Granbury, TX (US); Andrew G. V. Oldknow, Beaverton, OR (US); Jason P. Martin, Lake Oswego, OR (US); Carl A. Jonsson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 457 days.

This patent is subject to a terminal disclaimer.

(21) Appl. No.: 13/228,310

(22) Filed: Sep. 8, 2011

(65) Prior Publication Data

US 2012/0083353 A1 Apr. 5, 2012

Related U.S. Application Data

(63) Continuation-in-part of application No. 12/880,737, filed on Sep. 13, 2010, now Pat. No. 8,506,415.

(60) Provisional application No. 61/526,350, filed on Aug. 23, 2011.

(51) Int. Cl.

| | |
|---|---|
| ***A63B 69/36*** | (2006.01) |
| ***A63B 53/04*** | (2006.01) |
| ***A63B 53/06*** | (2006.01) |
| *A63B 59/00* | (2006.01) |

(52) U.S. Cl.

CPC ..... *A63B 53/0487* (2013.01); *A63B 59/0092* (2013.01); *A63B 2053/042* (2013.01); *A63B 2053/0429* (2013.01)

USPC ..... 473/251; 473/330; 473/332; 473/340; 473/341; 473/349

(58) Field of Classification Search

CPC ..... A63B 53/0487; A63B 59/0092; A63B 2053/0429; A63B 2053/042; A63B 2053/0425; A63B 53/065

USPC ..... 473/324–350, 287–292, 251–256

See application file for complete search history.

(56) References Cited

U.S. PATENT DOCUMENTS

| | | | |
|---|---|---|---|
| 873,423 | A | 12/1907 | Govan |
| 1,289,553 | A | 12/1918 | Sanders |

(Continued)

FOREIGN PATENT DOCUMENTS

| | | | |
|---|---|---|---|
| GB | 2313552 | A | 12/1997 |
| GB | 2388792 | A | 11/2003 |
| KR | 20080047955 | A | 5/2008 |

OTHER PUBLICATIONS

Office Action issued in related U.S. Appl. No. 12/720,623, on May 5, 2011.

(Continued)

*Primary Examiner* — Sebastiano Passaniti

(74) *Attorney, Agent, or Firm* — Banner & Witcoff, Ltd.

(57) ABSTRACT

Putter heads and putters include one or more of: (a) a main putter body portion including a first arm and a second arm; (b) a first polymeric and/or damping element engaged with the first arm; and (c) a second polymeric and/or damping element engaged with the second arm. The putter heads further may include polymeric material within the putter head structure and exposed at a central ball striking portion of the ball striking face, e.g., in elongated openings provided in the ball striking face. Grooves may be provided in the material of the ball striking face and/or in the exposed polymeric material to affect the ball launch. The putter heads may have various additional features or structures, e.g., relating to weighting features, alignment aid features, putter head constructions or parts, polymeric material exposure features, groove features, etc.

23 Claims, 17 Drawing Sheets

(56) References Cited

U.S. PATENT DOCUMENTS

| | | | | |
|---|---|---|---|---|
| 2,005,401 | A | 6/1935 | Storz | |
| 2,429,351 | A | 10/1947 | Fetterolf | |
| D210,033 | S | 1/1968 | Johnston | |
| 3,695,618 | A | 10/1972 | Woolley et al. | |
| 3,966,210 | A * | 6/1976 | Rozmus | 473/341 |
| 3,979,125 | A | 9/1976 | Lancellotti | |
| 4,679,792 | A | 7/1987 | Straza et al. | |
| D327,931 | S | 7/1992 | Stuff | |
| D327,932 | S | 7/1992 | Stuff | |
| 5,248,145 | A | 9/1993 | Brown | |
| 5,354,059 | A | 10/1994 | Stuff | |
| 5,358,249 | A | 10/1994 | Mendralla | |
| 5,398,929 | A | 3/1995 | Kitaichi | |
| 5,409,219 | A | 4/1995 | Saksun, Sr. | |
| 5,497,993 | A | 3/1996 | Shan | |
| 5,505,450 | A | 4/1996 | Stuff | |
| 5,518,235 | A | 5/1996 | Mendenhall | |
| 5,533,728 | A | 7/1996 | Pehoski et al. | |
| 5,542,675 | A | 8/1996 | Micciche et al. | |
| 5,620,381 | A | 4/1997 | Spalding | |
| 5,624,331 | A | 4/1997 | Lo et al. | |
| 5,637,044 | A | 6/1997 | Swash | |
| 5,655,976 | A | 8/1997 | Rife | |
| 5,766,093 | A | 6/1998 | Rohrer | |
| 5,769,737 | A | 6/1998 | Holladay et al. | |
| 5,772,527 | A | 6/1998 | Liu | |
| 5,807,190 | A | 9/1998 | Krumme et al. | |
| 5,944,619 | A | 8/1999 | Cameron | |
| 5,947,841 | A * | 9/1999 | Silvestro | 473/341 |
| 5,972,144 | A | 10/1999 | Hsu | |
| 6,093,116 | A | 7/2000 | Hettinger et al. | |
| 6,200,229 | B1 | 3/2001 | Grace et al. | |
| 6,302,807 | B1 | 10/2001 | Rohrer | |
| 6,309,310 | B1 | 10/2001 | Shira | |
| 6,334,818 | B1 | 1/2002 | Cameron et al. | |
| 6,348,014 | B1 | 2/2002 | Chiu | |
| 6,431,997 | B1 | 8/2002 | Rohrer | |
| 6,488,595 | B1 * | 12/2002 | Grace | 473/341 |
| 6,517,450 | B1 * | 2/2003 | Klyve | 473/340 |
| 6,558,272 | B2 | 5/2003 | Helmstetter et al. | |
| 6,652,390 | B2 * | 11/2003 | Bradford | 473/341 |
| 6,699,140 | B1 | 3/2004 | Sun | |
| 6,921,343 | B2 | 7/2005 | Solheim | |
| 6,932,716 | B2 | 8/2005 | Ehlers et al. | |
| 7,018,304 | B2 * | 3/2006 | Bradford | 473/334 |
| 7,166,039 | B2 | 1/2007 | Hettinger et al. | |
| 7,261,644 | B2 | 8/2007 | Burrows | |
| 7,278,926 | B2 | 10/2007 | Frame | |
| 7,281,990 | B2 | 10/2007 | Hagood | |
| 7,491,131 | B2 | 2/2009 | Vinton | |
| D588,222 | S | 3/2009 | Takahashi | |
| 7,594,862 | B2 | 9/2009 | Gilbert | |
| 7,594,863 | B2 | 9/2009 | Ban | |
| D605,242 | S | 12/2009 | Franklin et al. | |
| D615,140 | S | 5/2010 | Franklin et al. | |
| 7,717,801 | B2 | 5/2010 | Franklin et al. | |
| 7,758,449 | B2 | 7/2010 | Gilbert et al. | |
| 7,780,549 | B2 | 8/2010 | Park et al. | |
| 7,794,333 | B2 | 9/2010 | Wallans et al. | |
| 7,806,779 | B2 | 10/2010 | Franklin et al. | |
| 7,841,952 | B1 | 11/2010 | Oldknow et al. | |
| 7,846,039 | B2 | 12/2010 | Gilbert et al. | |
| 7,862,449 | B2 | 1/2011 | Stites et al. | |
| 7,867,104 | B2 * | 1/2011 | Franklin et al. | 473/251 |
| 7,927,230 | B2 | 4/2011 | Solheim | |
| 7,942,757 | B2 | 5/2011 | Blumenkrantz et al. | |
| 8,012,035 | B2 | 9/2011 | Franklin et al. | |
| 8,062,146 | B2 | 11/2011 | Franklin et al. | |
| 8,083,605 | B2 | 12/2011 | Franklin et al. | |
| 8,083,611 | B2 | 12/2011 | Kuan et al. | |
| 8,210,962 | B2 | 7/2012 | Franklin et al. | |
| 8,216,081 | B2 | 7/2012 | Snyder et al. | |
| 8,292,754 | B2 | 10/2012 | Snyder et al. | |
| 8,506,415 | B2 * | 8/2013 | Franklin | 473/251 |
| 2003/0013546 | A1 | 1/2003 | Bradford | |
| 2004/0242342 | A1 | 12/2004 | Patten | |
| 2005/0009623 | A1 | 1/2005 | Dickinson | |
| 2005/0137027 | A1 | 6/2005 | Thomas | |
| 2005/0209020 | A1 | 9/2005 | Burrows | |
| 2005/0215354 | A1 | 9/2005 | Kumamoto | |
| 2005/0233829 | A1 | 10/2005 | Cameron | |
| 2005/0277487 | A1 | 12/2005 | Takeda | |
| 2006/0223649 | A1 * | 10/2006 | Rife | 473/334 |
| 2007/0037632 | A1 | 2/2007 | Jorgensen | |
| 2007/0142122 | A1 | 6/2007 | Bonneau | |
| 2007/0161430 | A1 | 7/2007 | Bardha | |
| 2007/0191135 | A1 * | 8/2007 | Nilsson et al. | 473/340 |
| 2007/0243949 | A1 | 10/2007 | Solari | |
| 2008/0125241 | A1 | 5/2008 | Tateno et al. | |
| 2008/0153623 | A1 | 6/2008 | Ines | |
| 2008/0207351 | A1 | 8/2008 | Wallans et al. | |
| 2008/0293511 | A1 | 11/2008 | Gilbert | |
| 2009/0105008 | A1 | 4/2009 | Kuan et al. | |
| 2009/0131197 | A1 | 5/2009 | Miyamichi | |
| 2009/0149271 | A1 | 6/2009 | Nakamura | |
| 2009/0286620 | A1 | 11/2009 | Franklin et al. | |
| 2009/0286621 | A1 | 11/2009 | Franklin et al. | |
| 2009/0305807 | A1 | 12/2009 | Solheim et al. | |
| 2010/0087269 | A1 | 4/2010 | Snyder et al. | |
| 2010/0113179 | A1 | 5/2010 | Solheim | |
| 2010/0113184 | A1 * | 5/2010 | Kuan et al. | 473/340 |
| 2010/0167835 | A1 | 7/2010 | Franklin et al. | |
| 2010/0234127 | A1 | 9/2010 | Snyder et al. | |
| 2011/0034268 | A1 | 2/2011 | Franklin et al. | |
| 2011/0039633 | A1 | 2/2011 | Snyder et al. | |
| 2011/0070971 | A1 | 3/2011 | Franklin et al. | |

OTHER PUBLICATIONS

International Search Report issued in related PCT Application, International Application No. PCT/US2010/051432, on Mar. 30, 2011.

Office Action issued in related U.S. Appl. No. 12/467,812, mailed on Apr. 16, 2010.

Office Action issued Sep. 4, 2009 in U.S. Appl. No. 12/259,541, also owned by assignee NIKE, Inc.

C-Groove—Development, Harold Swash Putting School of Excellence, (Aug. 26, 2008), http://www.haroldswashputting.co.uk/haroldswash_development.htm.

Rife Two Bar Hybrid Putter Review, Putter Zone Golf, (Mar. 7, 2008), http://www.putterzone.com/2008/03/rife-twobar-hybrid-putter-review.html.

International Search Report in PCT Application, International Application No. PCT/US2009/044331, mailed Sep. 10, 2009.

Office Action issued Sep. 23, 2011 in U.S. Appl. No. 12/906,901, also owned by assignee NIKE, Inc.

International Search Report in PCT Application, International Application No. PCT/US2011/028674, mailed Jul. 18, 2011.

Office Action Dated Jan. 3, 2013 for U.S. Appl. No. 12/880,737, "Putter Heads and Putters Including Polymeric Material As Part of the Ball Striking Surface".

European Search Report received in corresponding European Application No. 11159319.0 issued on Sep. 23, 2011.

International Search Report received in corresponding PCT Application No. PCT/US2010/031156 issued on Jul. 6, 2010.

* cited by examiner

PUTTER HEADS AND PUTTERS

RELATED APPLICATION INFORMATION

This application is a continuation-in-part of U.S. patent application Ser. No. 12/880,737 filed Sep. 13, 2010 in the name of David N. Franklin entitled "Putter Heads and Putters Including Polymeric Material as Part of the Ball Striking Surface," and it also claims priority benefits based on U.S. Provisional Patent Appln. No. 61/526,350 filed Aug. 23, 2011 in the names of David N. Franklin, Andrew G. V. Oldknow, Jason Martin, and Carl Jonsson entitled "Putter Heads and Putters Including Polymeric Material as Part of the Ball striking Surface."

Additionally, information in this application builds on information contained in the following U.S. patents and patent applications: (a) U.S. Pat. No. 7,717,801 issued May 18, 2010 in the names of David N. Franklin and John Thomas Stites and entitled "Putter Heads and Putters Including Polymeric Material as Part of the Ball Striking Face," (b) U.S. Pat. No. 7,806,779 issued Oct. 5, 2010 in the names of David N. Franklin and John Thomas Stites and entitled "Putter Heads and Putters Including Polymeric Material as Part of the Ball Striking Face," (c) U.S. patent application Ser. No. 12/612,236 filed Nov. 4, 2009 in the names of Jeremy N. Synder, David N. Franklin, John T. Stites, and Donald S. Rahrig and entitled "Putter Heads and Putters Including Polymeric Material as Part of the Ball Striking Face," and (d) U.S. patent application Ser. No. 12/755,330 filed Apr. 6, 2010 in the names of Jeremy N. Synder, John T. Stites, David N. Franklin, and Donald S. Rahrig and entitled "Putter Heads and Putters Including Polymeric Material as Part of the Ball Striking Face."

Each of the earlier patents and patent applications identified in the paragraphs above is entirely incorporated herein by reference.

FIELD OF THE INVENTION

The invention relates generally to putter heads and putters. Putter heads and putters in accordance with at least some examples of this invention may be constructed to include rearward extending arms, polymeric and/or damping materials on the putter body, and/or a relatively soft polymeric material as at least a portion of the ball striking surface.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well-known golf superstars, at least in part, have increased golf's popularity in recent years both in the United States and across the world.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing aids and/or teaching aids also are available on the market that promise to help lower one's golf scores.

Being the sole instruments that set golf balls in motion during play, golf clubs also have been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, ball fitting technology, etc.).

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, ball characteristics, and the like all may affect the "feel" of the club as it swings and strikes a ball. "Feel" also has been found to be related to the visual appearance of the club and the sound produced when the club head strikes a ball to send the ball in motion.

To successfully putt a ball in the hole, the ball must be launched at a proper combination of speed and direction to arrive at the intended destination. While some errors in putt speed and/or direction may be the result of mental or physical mistakes by the player (e.g., mis-hits, mis-alignment, etc.), the putter also can contribute to inconsistencies in ball launch speed and/or launch direction that result in missed putts. For example, if the putter head twists in the player's hands before or during ball contact, this may cause the ball to start out "off-line," with some undesired spin and/or at the wrong speed. As another example, if the ball is launched with backspin or bounces excessively during the early phase of its locomotion, this can cause inconsistencies in ball speed. All of these things may result in missed putts and inconsistent putting.

While technological improvements to putter designs have been made, because of the very personal nature of the putting stroke and the "feel" aspects of putting a golf ball, no single putter structure is best suited for all players. New putter structures that change the look and feel of the club are welcomed by at least some players. Moreover, technological advances that provide improved and more consistent initial ball launch direction and launch speed would be a welcome advance in the art.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description that follows.

Aspects of this invention relate to putters and putter heads that include: (a) a ball striking face member including a front portion for contacting a ball during a putting stroke and a rear portion opposite the front portion; (b) a main putter body portion including: (1) a base surface, (2) a first arm at a first side of the base surface and extending away from the rear portion of the ball striking face member, and (3) a second arm at a second side of the base surface, the second arm extending away from the rear portion of the ball striking face member and away from the first arm; and (c) a polymeric element engaged with at least one of the base surface, the first arm, or the second arm.

Other aspects of this invention relate to putters and putter heads that include one or more of the following: (a) a main putter body portion including a first arm and a second arm; (b) a first element engaged with the first arm; (c) a second element engaged with the second arm; (d) a ball striking face member engaged with or integrally formed as part of the main putter body portion, the ball striking face member including a central portion for contacting a ball during a putting stroke, wherein the central portion includes a plurality of openings defined therein; (e) a polymeric material located between at least the central portion of the ball striking face member and the main putter body portion, wherein a portion of the polymeric material is exposed at an exterior surface of the ball striking face member through the plurality of openings; and/or (f) a shaft engaged with the putter head (e.g., with at least one of the main putter body portion or the ball striking face member). The elements engaged with the arms of the main putter body portion may be polymeric elements, e.g., provided to control the weighting characteristics of the putter head and/or to dampen or attenuate vibration (e.g., when a ball is struck). If desired, a hosel for engaging the shaft may be provided on a third arm of the main putter body portion that extends above the ball striking face member. Putter heads in accordance with examples of this aspect of the invention may have various additional features or structures, e.g., relating to weighting features, alignment aid features, putter head constructions or parts, polymeric material exposure features, groove features, etc., as described in more detail below.

Still additional aspects of this invention relate to putters and putter heads that include: (a) a main putter body portion including a ball striking face having a central recess defined therein, a first arm, and a second arm; (b) a first element engaged with the first arm; (c) a second element engaged with the second arm; (d) an insert engaged within the central recess of the main putter body portion, the insert including a polymeric base material, wherein a plurality of depressions are defined in an exposed surface of the polymeric base material, wherein at least some of the plurality of depressions include an edge element mounted therein to thereby provide a ball striking surface of the putter head with grooves defined therein between edges of the depressions and adjacent edges of the edge elements mounted within the depressions; and/or (e) a shaft engaged with the putter head (e.g., with the main putter body portion). Again, the elements engaged with the arms of the main putter body portion may be polymeric elements, e.g., provided to control the weighting characteristics of the putter head and/or to dampen or attenuate vibration (e.g., when a ball is struck). Putter heads in accordance with examples of this aspect of the invention may have various additional features or structures, e.g., relating to weighting features, alignment aid features, putter head constructions or parts, polymeric material exposure features, groove features, etc., as described in more detail below.

Additional aspects of this invention relate to methods for making putting devices, e.g., such as putters and putter heads of the types described above. Such methods will be described in more detail below.

BRIEF DESCRIPTION OF THE DRAWINGS

A more complete understanding of the present invention and certain advantages thereof may be acquired by referring to the following detailed description in consideration with the accompanying drawings, in which the same reference numbers indicate the same or similar features, and wherein.

DETAILED DESCRIPTION

Figure 1A:
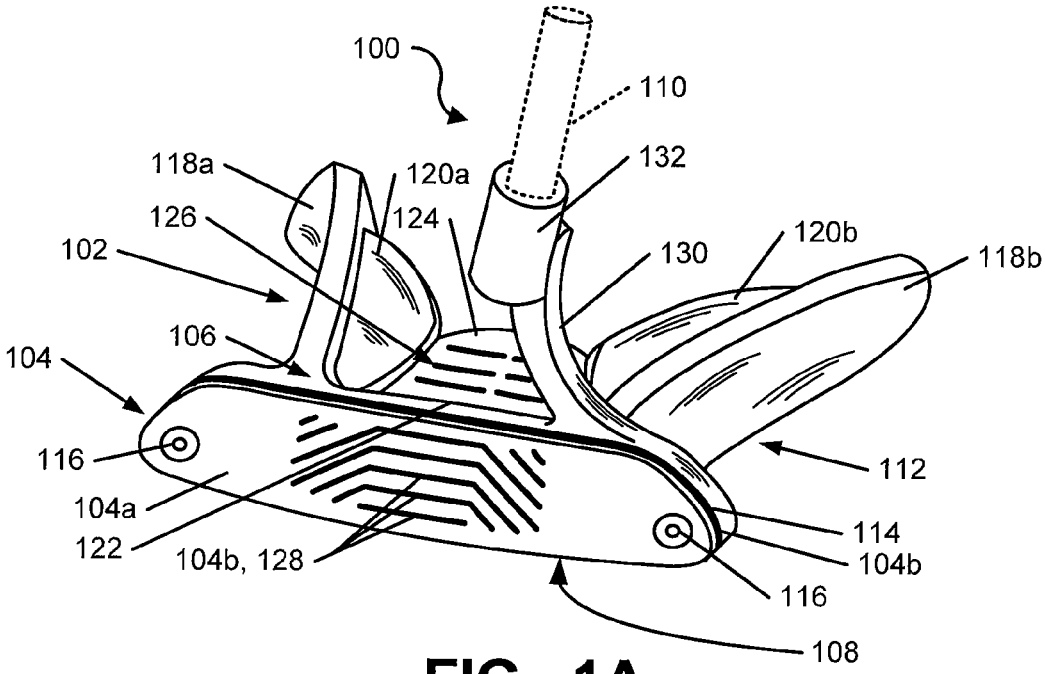
FIGS. 1A and 1B illustrate a first example putter head structure in accordance with aspects of this invention.

In the following description of various example putter heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures and/or the orientations during typical use (e.g., at a ball address orientation). Nothing in this specification should be construed as requiring a specific three dimensional orientation of structures in order to fall within the scope of this invention.

At least some example aspects of this invention relate to putters and putter heads, as well as to methods of making such structures. A general description of aspects of the invention followed by a more detailed description of specific examples of the invention follows.

A. General Description of Putters, Putter Heads, and Methods According to Aspects of the Invention In general, aspects of this invention relate to putters and putter heads. One example aspect of this invention relates to putters and putter heads that include: (a) a ball striking face member including a front portion for contacting a ball during a putting stroke and a rear portion opposite the front portion; (b) a main putter body portion including: (1) a base surface, (2) a first arm at a first side of the base surface and extending away from the rear portion of the ball striking face member, and (3) a second arm at a second side of the base surface, the second arm extending away from the rear portion of the ball striking face member and away from the first arm; and (c) a polymeric element engaged with at least one of the base surface, the first arm, or the second arm. The polymeric element may constitute a single component or a multi-piece component, e.g., that extends along the base surface of the main putter body portion from the first arm to the second arm, and optionally up along the side surfaces of the arm and/or up the rear surface of the putter ball striking face. Optionally, if desired, at least one of the base surface, the first arm, or the second arm may include an opening defined through it and/or a thinned area (e.g., to reduce weight of the putter body portion).

The base surface of the main putter body portion may include a rearmost component extending in a direction between a rearmost portion of the first arm and a rearmost portion of the second arm. While it may connect to the arms, if desired, in at least some examples of this invention, the rearmost component will not extend to contact the first and second arms (i.e., the rearmost component may include free ends).

Additional putters and putter heads, according to at least some examples of the invention, may include one or more of the following: (a) a main putter body portion including a first arm and a second arm; (b) a first element engaged with the first arm (e.g., made from a polymeric material and/or provided for vibration damping); (c) a second element engaged with the second arm (e.g., made from a polymeric material and/or provided for vibration damping); (d) a ball striking face member engaged with or integrally formed as part of the main putter body portion, the ball striking face member including a central portion for contacting a ball during a putting stroke, wherein the central portion includes a plurality of openings defined therein; (e) a polymeric material located between at least the central portion of the ball striking face member and the main putter body portion, wherein a portion of the polymeric material is exposed at an exterior surface of the ball striking face member through the plurality of openings; and/or (f) a shaft engaged with the putter head (e.g., with at least one of the main putter body portion or the ball striking face member). If desired, a hosel for engaging the shaft may be provided on a third arm of the main putter body that extends above the ball striking face member. Also, if desired, the first element (engaged with the first arm) and the second element (engaged with the second arm) may constitute opposite sides or edges of a single polymeric member mounted on the main putter body portion that extends from the first arm to the second arm.

If desired, putter heads and putters in accordance with at least some examples of this invention may include weight members, e.g., to improve the club head's balance, to affect the club head's center of gravity location, to affect the club head's moment of inertia (particularly about a vertical or Z-axis located at the club head's center of gravity (Izz)), to allow user customization of the club head's feel, etc. As some more specific examples, such putter heads and putters may include at least a first weight member engaged with the first arm of the main putter body portion (e.g., at the arm's free end) and a second weight member engaged with the second arm (e.g., at the arm's free end). Optionally, these weight members may be releasably mounted to the arms in a weight port or other weight engaging structure by some type of mechanical connector, such as a threaded connection, to enable easy removal, replacement, and interchange of weight members. The polymeric material (or at least portions of it) also may act as weight members (e.g., rubberized tungsten or other polymeric materials doped with lead, tungsten, or other dense materials).

Additional aspects of this invention relate to the putter head's alignment aid(s). For example, if desired, a portion of the polymeric material may be exposed at an upper surface of the putter head to function as an alignment aid. This may be accomplished, for example, by having the exposed polymeric material form a line along at least the top surface of the putter head, wherein the line extends in a direction parallel to the ball striking surface of the putter head. Other alignment aid shapes and configurations also may be made using exposed polymeric material provided in the putter body. As additional or alternative potential features, at least a portion of an alignment aid may be provided on the main putter body portion, e.g., on a surface extending between the first arm and the second arm. This surface may be integrally formed as part of the arms and/or the main putter body portion or it may be one or more separate parts attached to the main putter body portion (e.g., to the arms). The alignment aid on this surface may include, for example, one or more shapes (such as rectangles or line segments) that are generally arranged such that an overall exterior perimeter of the alignment aid has a triangular shape (e.g., an isosceles triangle) or a trapezoidal shape with a first side extending in a direction substantially parallel to a ball striking surface of the ball striking face member (optionally, this parallel first side will be the side located closest to the ball striking face member). In putter head structures in accordance with examples of this invention where both the exposed top surface polymeric material and a separate main putter body portion alignment aid are provided, at least some of the features of the main putter body alignment aid (e.g., one or more of its color, texture, surface reflectivity, size, orientation, etc.) may match or complement corresponding features of the polymeric material exposed at the top surface of the putter head.

The polymeric material may be included in the overall putter structure in a variety of different manners and with a variety of different characteristics without departing from this invention. As one example, the ball striking face member may constitute a plate member that is separate from and engaged with a front surface of the main putter body portion with the polymeric material sandwiched between the plate member and the main putter body portion. If desired, in such an arrangement, a portion of the polymeric material may be exposed around a 360 degree perimeter of the putter head between the plate member and the main putter body portion (and, as noted above, the exposed top surface may function as an alignment aid). As another example, the main putter body portion may form a portion of the ball striking surface and the ball striking face member may constitute an insert element that is engaged within a recess provided in the main putter body portion with the polymeric material provided in the recess behind the front-most surface of the ball striking face member. If desired, the insert element may include a first layer (optionally made from a metal material) that is exposed at the ball striking surface and a second layer that constitutes the polymeric material (most of which is located within the recess behind the first layer). The first layer may be harder than the second layer, in such structures.

As noted above, putter head and putter structures in accordance with at least some examples of this invention may include one or more elements engaged with the arms of the main putter body portion. These elements may be polymeric material arranged on the arms so that at least some portions of the exposed surfaces of the polymeric elements face one another (e.g., the elements may be mounted on surfaces of the arms located closest to the putter head's geometric center). Alternatively, these elements may be arranged so that their exposed surfaces face away from one another (e.g., on surfaces of the arms located furthest away from the putter head's geometric center). As yet another example, if desired, these elements may be located on both of these types of surfaces, as well as on other surfaces of the main putter body portion. These elements, as noted above, may be made from polymeric material, and this material may be used to control the weighting characteristics of the putter head and/or to dampen or attenuate vibrations in the putter head when a ball is struck. If desired, two or more of these elements may be connected to one another, optionally by the same or similar material extending between the two arms, e.g., along a surface of the main putter body portion.

Additional aspects of this invention relate to features of the ball striking surface of the putter head, e.g., at the central portion of the ball striking face member between a top and a bottom of the putter head. Putter heads in accordance with at least some examples of this invention will include a top-to-bottom cross section of the exposed ball striking surface at the central portion of the ball striking face having alternating polymeric material and metal material and a plurality of grooves. These grooves may include, for example, one or more grooves defined in the exposed ball striking surface, wherein, in the cross section, first edges of these groove are defined by metal material and second edges of these grooves opposite the corresponding first edges are defined by polymeric material (the polymeric material may be softer than the metal material). The plurality of grooves may extend in parallel along at least some part of the central portion of the ball striking face. The grooves further may be formed in either or both of (a) the material making up the ball striking face member between adjacent openings and (b) the polymeric material exposed in the openings in the ball striking face member.

In some example putter head structures in accordance with this invention, the plurality of openings in the ball striking face member will include at least a first elongated opening that extends across the central portion of the ball striking face member, wherein a first groove is defined in a ball striking surface of the putter head and is formed such that a material making up the central portion of the ball striking face member forms a first edge of the first groove and the polymeric material exposed in the first elongated opening forms a second edge of the first groove located opposite the first edge. Again, this groove may be formed in either or both of (a) the material making up the ball striking face member between adjacent openings and (b) the polymeric material exposed in the openings in the ball striking face member. The grooves may have any desired cross sectional shape (e.g., square, rectangular, V-shaped, C-shaped, etc.).

Another aspect of this invention relates to putter heads that include: (a) a main putter body portion including a ball striking face having a central recess defined therein, a first arm, and a second arm; (b) a first element (e.g., a polymeric element and/or a damping element) engaged with the first arm; (c) a second element (e.g., a polymeric element and/or a damping element) engaged with the second arm; and (d) an insert engaged within the central recess of the main putter body portion, the insert including a polymeric base material. A plurality of depressions may be defined in an exposed surface of the polymeric base material, wherein at least some of the plurality of depressions include an edge element mounted therein to thereby provide a ball striking surface of the putter head with grooves defined therein between edges of the depressions and adjacent edges of the edge elements mounted within the depressions. Such putter heads also may include any of the various features described above (e.g., alignment aid features, weighting features, etc.)

At least some putter heads and putter constructions in accordance with this invention will include one or more weights engaged with a toe side edge of the ball striking face member and/or one or more weights engaged with a heel side edge of the ball striking face member. At least some of these weights (and optionally any mounting ports therefor) may be completely located within 1.5 inches in a front-to-rear direction from a forward-most ball striking surface of the ball striking face member (and optionally within 1 inch or less or even 0.75 inches or less in the front-to-rear direction from the ball striking surface). As opposed to the side edges, weights of this type (near the ball striking surface) also may be mounted on the top or bottom surfaces of the putter head.

Additional aspects of this invention relate to methods for making putter devices (such as putters and putter heads of the types described above). Such methods may include, for example, one or more of the following steps: (a) placing a polymeric material between a central portion of a ball striking face member and a main putter body portion, wherein the ball striking face member is engaged with or integrally formed as part of the main putter body portion, wherein the main putter body portion includes a first arm and a second arm, wherein the central portion of the ball striking face member includes a plurality of openings defined therein, and wherein a portion of the polymeric material is exposed at an exterior surface of the ball striking face member through the plurality of openings; (b) engaging a first element (e.g., a polymeric element and/or a damping element) with the first arm; (c) engaging a second element (e.g., a polymeric element and/or a damping element) with the second arm; (d) engaging a shaft with at least one of the ball striking face member and the main putter body portion; (e) engaging a first weight member with the first arm; and/or (f) engaging a second weight member with the second arm. The putting device (e.g., the putting head) further may be formed to include any one or more of the features described above (e.g., weighting features, alignment aid features, putter head constructions, polymeric material exposure features, groove features, etc.).

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of putters, components thereof, and methods in accordance with examples of this invention. When the same reference number appears in more than one drawing, that reference number is used consistently in this specification and the drawings to refer to the same or similar parts throughout.

Figure 1B:
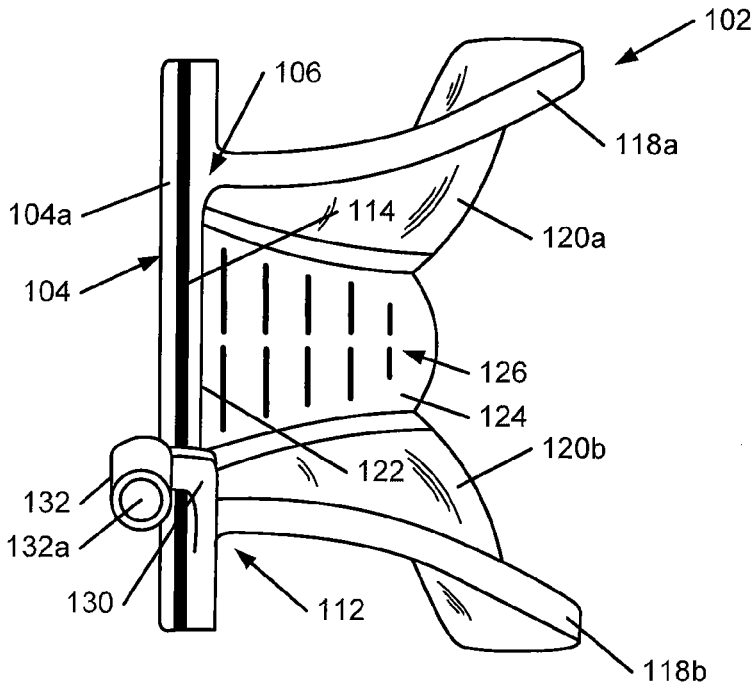

FIGS. 1A and 1B illustrate an example putter structure 100 in accordance with this invention. The putter 100 includes a putter head 102 having a ball striking surface 104, a top surface 106 (visible when looking down at the putter head 102 at a ball address position, e.g., as shown in FIG. 1B), a bottom portion 108 (not visible when looking down at the putter head 102 at the ball address position), and a shaft member 110 engaged with the putter head 102. The putter head 102 may be constructed from one or more parts and may be made from any desired materials (or combinations of materials) without departing from this invention, including, for example, metals, metal alloys (such as aluminum, titanium, aluminum alloys, titanium alloys, stainless steel, etc.), and the like, including materials that are conventionally known and used in the art.

Likewise, the shaft member 110 may be made of any desired materials without departing from this invention, including, for example, metals, metal alloys, composites, and the like, including materials that are conventionally known and used in the art.

As illustrated in FIG. 1A, the exposed ball striking surface 104 of this example putter head 102 includes at least two different surface features. One portion of the ball striking surface 104, the ball striking face member 104*a*, may be contiguous or integral with the base material for the ball striking surface 104, such as the materials described above for the putter head 102 or other conventional materials used for putter ball striking faces. Another portion of the exposed ball striking surface 104 is made from a polymeric material 104*b*. In at least some example structures in accordance with this invention, the polymeric material 104*b* generally will be softer and more lightweight (e.g., less dense) as compared to the material of the remainder of the ball striking surface 104, including ball striking face member 104*a*. As illustrated in FIG. 1A, in this example structure, the two portions 104*a* and 104*b* of the ball striking surface 104 extend across a central portion of the ball striking surface 104 of the putter head 102 in an alternating manner, such that a plurality of parallel strips of polymeric material 104*b* are separated by a plurality of strips of the ball striking face material 104*a*. Examples of the construction of putter heads to include this alternating material structure, and other structures including combinations of materials, will be described in more detail below.

One potential advantage of providing a polymeric material within a putter head relates to the potential for weight savings. By removing some of the metal material from the putter head body, this material may be at least partially replaced by a lighter weight or less dense polymeric material. This weight savings allows the club designer to place additional weight at other areas of the putter head structure, such as toward the rear corners of the putter head structure (as will be described in more detail below). Such features may allow the club designer to control and design a club head having a higher moment of inertia (resistance to twisting, particularly about a vertical axis) and desired center of gravity location characteristics. Additionally, by including this relatively soft polymeric material 104*b* as part of the ball striking surface 104 (such that the polymeric material 104*b* also directly contacts the ball during a putt) and in the putter head 102, the ball strike characteristics of the putter head may be altered and controlled, which affects the launch, sound, rebound, and other "feel" characteristics of the putter head 102 (e.g., by damping vibrations and altering the sound of a ball strike). The polymeric material 104*b* and/or the junction between the polymeric material 104*b* and the ball striking face member 104*a* also may influence ball spin as the ball comes off the putter face. These features also will be described in more detail below.

The example putter head structure 102 of FIGS. 1A and 1B includes the ball striking face member 104*a* engaged with a main putter body portion 112 with a layer of polymeric material 104*b* sandwiched between the ball striking face member 104*a* and the main putter body portion 112. The main putter body portion 112 may constitute one or more component parts that are engaged together to form a main (or rear) portion of the putter head body, and this main body portion may be made from any desired materials (or combinations of materials) without departing from this invention, including, for example, metals (e.g., aluminum, titanium, etc.), metal alloys (such as stainless steel, aluminum alloys, titanium alloys, etc.), polymeric materials, and the like, including materials that are conventionally known and used in the art.

As shown in FIGS. 1A and 1B, this example putter main body portion 112 includes a base surface 114 (e.g., optionally a planar or substantially planar surface) against which the polymeric material 104*b* may be mounted. This base surface 114 may include structures for engaging and/or securing the ball striking face member 104*a* with the polymeric material 104*b* sandwiched between the ball striking face member 104*a* and the putter main body portion 112. As one more specific example, the base surface 114 of the putter head main body portion 112 may include threaded holes for receiving threaded bolt members 116 that extend through the ball striking face member 104*a* and the polymeric material 104*b*. As another option, the bolt members 116 may extend through the ball striking face member 104*a*, the polymeric material 104*b*, and a portion of the putter main body portion 112 and secure these members together by a separate threaded nut located behind the base surface 114. Any number of bolt members 116 and/or other ways of securing the ball striking face member 104*a* and/or the polymeric material 104*b* with the putter main body portion 112 may be used without departing from this invention, including releasable connections (e.g., other mechanical connections) and permanent connections (e.g., adhesives, cements, fusing techniques, such as welding, etc.).

The putter main body portion 112 of this example structure further includes two arms 118*a* and 118*b* that extend in a direction away from the ball striking face 104 and away from one another (as one moves rearward in the overall putter head structure). These arms 118*a* and 118*b* may be integrally formed with the base surface 114, or they may be engaged with the rear 122 of the base surface 114. In this illustrated example, the arms 118*a* and 118*b* have a generally rectangular cross-sectional shape from top to bottom and have a curved or twisted construction and generally extend rearward and outward (away from one another) with respect to a geometric center of the ball striking face 104. The arms 118*a* and 118*b* of this example bend outward away from each other and their bottoms are twisted outward at their free ends with respect to their tops. The curved lines of the arms 118*a* and 118*b* may mimic and/or help the golfer visualize a smooth flowing arc of a swing of a putter.

Each arm 118*a* and 118*b* of this example structure further includes a polymeric element 120*a* and 120*b*, respectively, engaged therewith. The polymeric elements 120*a* and 120*b* may dampen or attenuate vibrations throughout the putter head 102 and shaft 110 when a ball is contacted by the putter head 102 and/or they may be used to control the weighting characteristics of the putter head 102 (e.g., center of gravity location, moment of inertia characteristics, etc.). The polymeric elements 120*a* and 120*b* may take on a wide variety of shapes, constructions, and arrangements in the putter main body portion 112 without departing from this invention. For example, each element 120*a* and 120*b* may constitute one or more separate parts, or the two elements 120*a* and 120*b* may be interconnected (e.g., along the rear 122 of the base surface 114, along the intermediate surface 124 (if any), etc.). As other options, rather than (or in addition to) providing the elements 120*a* and 120*b* where at least portions of their exposed surfaces face one another as shown in FIGS. 1A and 1B (e.g., on the interior portions of arms 118*a* and 118*b* with respect to the club head's center of gravity), one or more similar polymeric elements may be provided on each arm 118*a* and 118*b* where at least portions of their exposed surfaces face away from one another (e.g., on the exterior portions of arms 118*a* and 118*b* with respect to the club head's center of gravity).

The polymeric elements 120*a* and 120*b* may be engaged with the arms 118*a* and 118*b* in any desired manner without departing from this invention, such as via adhesives or cements, via mechanical connectors, etc. Also, if desired, the polymeric elements 120*a* and 120*b* may fit into recessed areas or openings provided in the surfaces of the arms 118*a* and 118*b*.

Any desired material(s) may be used for the elements 120*a* and 120*b* without departing from this invention, including, for example elastomeric polymer materials, such as polyurethanes (including thermoplastic polyurethanes), rubbers (synthetic and natural), latexes, foamed polymeric materials, ethylvinylacetates, etc. Also, while any desired hardnesses may be used for these elements 120*a* and 120*b* without departing from this invention, in some examples of this invention, the elements 120*a* and 120*b* may have a Shore A hardness of less than 140 (optionally in the range of 60 to 120) and/or a Shore D hardness of less than 60 (optionally in the range of 30 to 55).

FIGS. 1A and 1B further illustrate that the top surface 106 of the main putter body portion 112 of this example structure includes a third arm 130 that extends upward above a majority of the top surface 106 of the main putter body portion 112. This third arm 130 includes structure 132 for engaging a putter shaft 110. FIGS. 1A and 1B show the shaft engaging structure 132 as a female type hosel member including opening 132*a* into which a free end of the shaft 110 is inserted. Other shaft engaging structures may be provided without departing from this invention, including male type hosel members, longer or shorter arms 130, arms of different dimensions (e.g., sizes, shapes, etc.), and the like. Additionally or alternatively, the arm 130 may extend from or be engaged with one or more of: the ball striking face member 104*a*, the polymeric material 104*b*, and/or other parts of the main putter body portion 112 (such as intermediate surface 124), etc. As yet another example, if desired, the shaft 110 may be engaged with the putter head (e.g., one or more of the ball striking face member 104*a*, the polymeric material 104*b*, and/or the main putter body portion 112 (such as intermediate surface 124 or top surface 106)) in a hosel-less manner (e.g., by providing a shaft receiving opening directly in one or more of the various club head parts) without departing from this invention. The putter head 102 may be center shafted or heel shafted.

As noted above, the putter main body portion 112 of this example structure includes an intermediate surface 124 extending between the arms 118*a* and 118*b*. This surface 124 may be integrally formed with the arms 118*a* and 118*b* and/or with the rear 122 of the base surface 114, or it may be separate from these members (and optionally joined to at least one of them in some manner). In this illustrated example, the surface 124 includes an alignment aid 126 thereon. This example alignment aid 126 includes several line segments aligned in parallel from the rear 122 of the base surface 114 toward a rear center of the putter head body 102. The line segments of this example structure generally get somewhat shorter as one moves rearward to thereby form somewhat of a general trapezoidal or truncated cone exterior perimeter to this overall alignment aid 126. Alignment aids on surface 124 may take on a wide variety of different features without departing from this invention, several options of which are described in more detail below.

In at least some example putter heads 102 in accordance with this invention, as shown in FIGS. 1A and 1B, the polymeric material 104*b* may be exposed at least at some portion of the top surface 106 of the putter head 102. This exposed polymeric material 104*b* also may function as an alignment aid for the putter head 102. For example, as shown in FIGS. 1A and 1B, the exposed polymeric material 104*b* may have a color that makes it stand out on the top surface 106 of the putter head 102. Additionally, to assist in functioning as an alignment aid, this exposed polymeric material 104*b* may extend in a direction parallel to the direction of the ball striking surface 104 (e.g., as a line or line segment).

If desired, some example putter head structures in accordance with aspects of this invention may combine features of the polymeric material 104*b* alignment aid and the intermediate surface 124 alignment aid 126 to get an improved overall or composite alignment aid effect. For example, the alignment aid 126 on the intermediate surface 124 may have some of the same features of the exposed polymeric material 104*b* alignment aid so that these aids are visually tied together and/or work in manners that complement one another. As some more specific examples, the alignment aid 126 may have the same color, texture, and/or surface reflectivity as the exposed polymeric material 104*b*. If desired, the alignment aid 126 may be made from the same material as the exposed polymeric material 104*b* (e.g., as strips of material adhered to surface 124). As additional examples, the size, shape, and/or orientation of the alignment aid 126 may provide features to draw the eye forward toward the ball, such as longer line segments toward the front of the putter head 102 and progressively shorter line segments as one moves rearward. Other example alignment aids are described in more detail below in conjunction with FIGS. 9-14A.

Figure 2A:
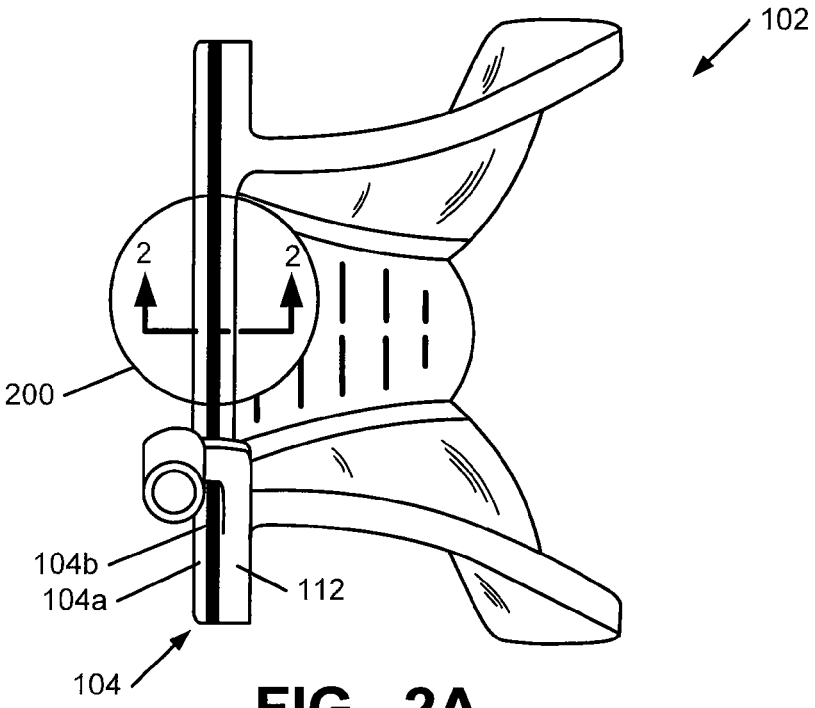
FIGS. 2A through 2G illustrate various example ball striking surface features of putter head structures in accordance with aspects of this invention.
Figure 2B:
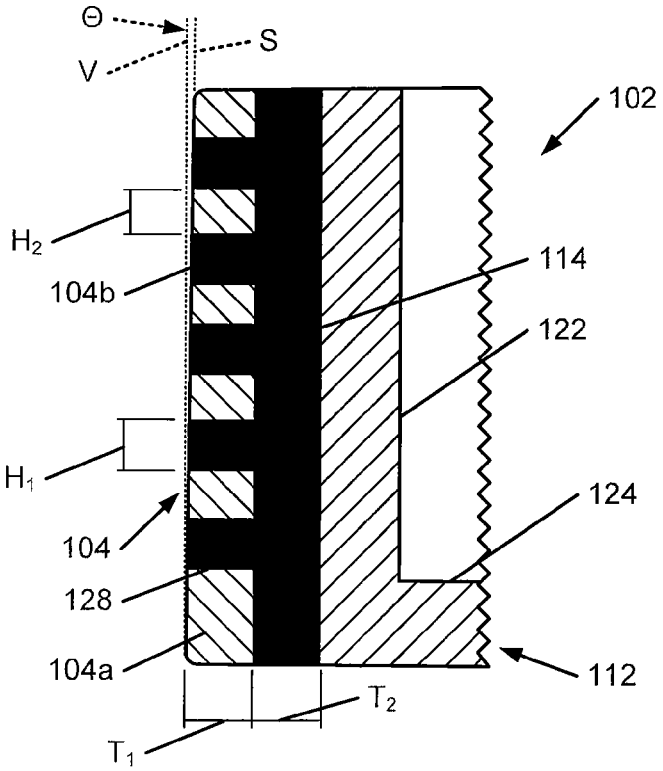

FIGS. 2A through 2G illustrate additional details of putter head structures 102 in accordance with at least some examples of this invention. FIG. 2A is a top view of the putter head 102 to illustrate the location of the section line and FIGS. 2B through 2G illustrate various alternative partial cross sectional views taken along line 2-2 in FIG. 2A. As shown in FIGS. 2A and 2B, like FIGS. 1A and 1B above, the ball striking surface 104 of the putter head 102 includes two distinct portions 104*a* and 104*b*, namely, a portion made up of the material making the ball striking face member 104*a* and a portion made from a polymeric material 104*b* as described above. The polymeric material portion 104*b* is filled into openings (e.g., slots) 128 defined in the ball striking face member 104*a* of the putter head 102. The openings 128 may be formed in the ball striking face member 104*a* in any desired manner without departing from this invention, including, for example, by forming the ball striking face member 104*a* to include such openings 128 (e.g., during the molding, casting, forging, or other production process), by machining such openings 128 into the ball striking face member 104*a* (e.g., grinding, punching or cutting them through a plate, etc.), etc. Any desired number of openings 128 in any desired arrangement may be provided in a ball striking face member 104*a* without departing from this invention.

The openings 128 expose the polymeric material 104*b* and allow it to extend to the ball striking surface 104 (i.e., positioned to contact the ball during a putt). A variety of different face constructions are possible without departing from this invention, and several examples or alternatives are described in more detail below (in this illustrated example, the polymeric material 104*b* is sandwiched between the ball striking face member 104*a* and the mounting surface 114 of the main putter body portion 112).

FIG. 2B illustrates an enlarged portion of the putter head structure 102 shown in FIG. 2A (the encircled portion 200 from FIG. 2A). As shown, the ball striking surface 104 includes both the metal (or other) material of the ball striking face member 104*a* and the exposed polymeric material 104*b* present in the openings 128 defined in the ball striking face member 104*a*. The openings 128 (and thus the height of the exposed polymeric material 104*b* in the top-to-bottom direction on the ball striking surface 104) may be made of any desired size without departing from this invention. For example, these openings 128 (and thus the height $H_1$ of the exposed polymeric material 104*b*) may be in the range of 0.03 to 0.5 inches, and in some examples, from about 0.1 to 0.3 inches. Likewise, the height of the metal (or other) material 104*a* between adjacent openings 128 (and thus the height $H_2$ between adjacent portions of the polymeric material 104*b*) may be made of any desired size without departing from this invention. For example, the height $H_2$ may be in the range of 0.03 to 0.5 inches, and in some examples, from about 0.1 to 0.3 inches. The heights $H_2$ between adjacent openings 128 may be less than, equal to, or greater than the heights $H_1$ of the polymeric material portions 104*b* in a given putter head structure. Additionally, the heights $H_1$ and $H_2$ may be of a constant size or of different sizes in a given putter head structure without departing from this invention. The heights $H_1$ and $H_2$ also may change over the course of the length of the individual openings 128 and/or the spaces between the openings 128 (e.g., in a heel-to-toe direction of the putter ball striking face). A wide variety of potential combinations of sizes of the various portions 104*a* and 104*b* are possible.

The thicknesses $T_1$ and $T_2$ of the ball striking face member 104*a* and the polymeric material 104*b*, respectively, also may vary without departing from this invention. As more specific examples, these thicknesses $T_1$ and $T_2$ may be the same or different and may range, for example, from 0.1 to 2 inches, and in some examples, from about 0.25 to 1 inch. These thicknesses also may change over the heel-to-toe direction of the putter ball striking face.

As illustrated in FIG. 2B, the ball striking surface 104 may be smooth (e.g., the portions 104*a* and 104*b* may smoothly transfer from one portion to the next in the alternating portion structure). The ball striking surface 104 may be flat, or it may include some roll or bulge characteristics, and/or it may have some desired loft characteristic. In this illustrated example, the putter ball striking surface 104 will have a loft angle Θ of 3° or less, and in some examples, the angle Θ may be 2.5° or less or even 2° or less. The loft angle Θ corresponds to the angle of the face surface S (with the putter head at a ball address position) with respect to a vertical line V.

Figure 2C:
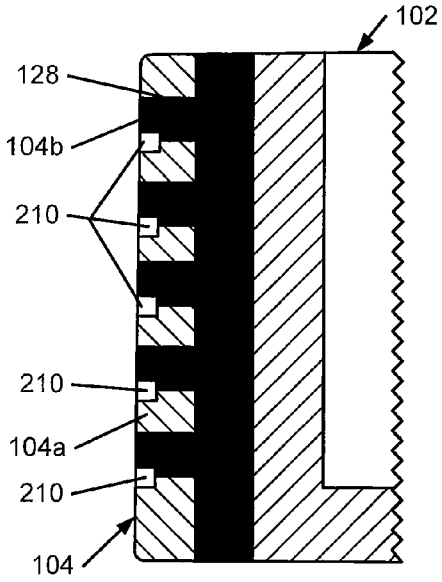
Figure 2D:
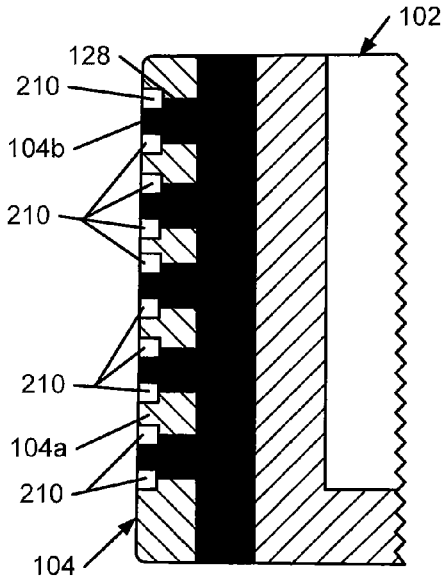

A flat and/or smooth ball striking surface 104 is not a requirement. To the contrary, as illustrated in FIGS. 2C through 2G, the ball striking surface 104 may include one or more grooves or scorelines 210 formed therein. As illustrated in the example structures of FIGS. 2C and 2D, the grooves 210 may be formed at an area of the ball striking surface 104 bridging the junctions between the metal ball striking face member 104*a* and the exposed polymeric material 104*b* such that the grooves 210 are provided partially in each of these materials 104*a* and 104*b*. The grooves 210 may be integrally formed in the portions 104*a* and 104*b* when the various parts of the ball striking surface 104 are formed (e.g., during the molding, casting, forging, or other forming process), and/or they may be formed at a later time (e.g., after the polymeric material 104*b* is placed in the putter head structure 102, e.g., by a cutting or machining process). FIG. 2C illustrates an example putter head structure 102 in which the grooves 210 are formed at the junctions of the bottom of a polymeric portion 104*b* and the top of the adjacent metal portion 104*a*. If desired, this structure could be flipped such that the grooves 210 are formed at the junctions of the top of a polymeric portion 104*b* and the bottom of the adjacent metal portion 104*a*. FIG. 2D, on the other hand, illustrates another example putter head structure 102 in which the grooves 210 are formed: (a) at the junctions of the bottom of a polymeric portion 104*b* and the top of the adjacent metal portion 104*a* and (b) at the junctions of the top of a polymeric portion 104*b* and the bottom of the adjacent metal portion 104*a*. In other words, in the structure of FIG. 2C, at least some of the metal portions 104*a* and the polymeric portions 104*b* have a single groove 210 defined therein, whereas in the structure of FIG. 2D, at least some of the metal portions 104*a* and the polymeric portions 104*b* have two grooves 210 defined therein (one groove at their top and one groove at their bottom).

Providing grooves or scorelines (e.g., like grooves 210) can affect the manner in which the ball leaves the putter ball striking surface 104 during the course of a putt. For example, the grooves 210 can affect launch angle and/or ball spin as the ball leaves the putter ball striking surface 104 during a putt. As one more specific example, in at least some instances, the grooves 210 and the polymeric material 104*b* will grip the ball somewhat and produce top spin on the ball when putted (particularly if ball contact occurs while the putter head movement includes an upward vertical component or on the upswing), which tends to get the ball rolling earlier and truer (e.g., and may eliminate some early bouncing during a putt).

The grooves 210 may have any desired height without departing from this invention. For example, if desired, the grooves 210 may extend up to 10% of the height of the portion 104*a* and/or 104*b* into which it is provided, and in some examples, up to 25% or even up to 50% or 75% of this height. The grooves 210 may extend into the portions 104*a* and/or 104*b* (in the front-to-rear or depth direction), for example, a distance of about 0.25 to 2 times the groove's height, and in some examples, from 0.5 to 1.5 times the groove's height. The grooves 210 also may have any desired cross sectional shape in the top-to-bottom and front-to-rear directions, such as U-shaped, V-shaped, C-shaped, etc. The various grooves 210 on a putter ball striking surface 104 may have the same or different sizes and/or shapes, and every junction and/or every portion 104*a* and/or 104*b* on a given putter structure need not include an associated groove 210.

Figure 2E:
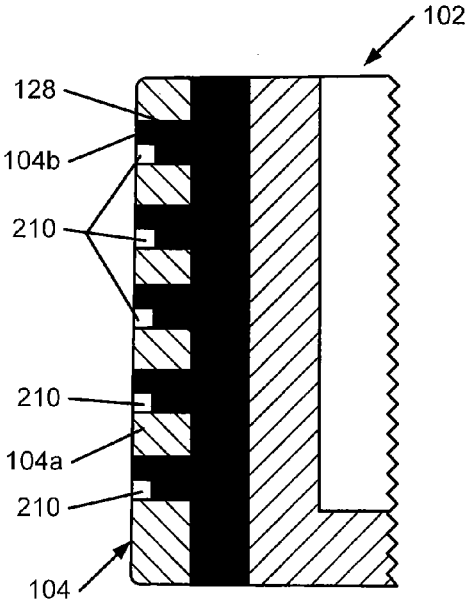
Figure 2F:
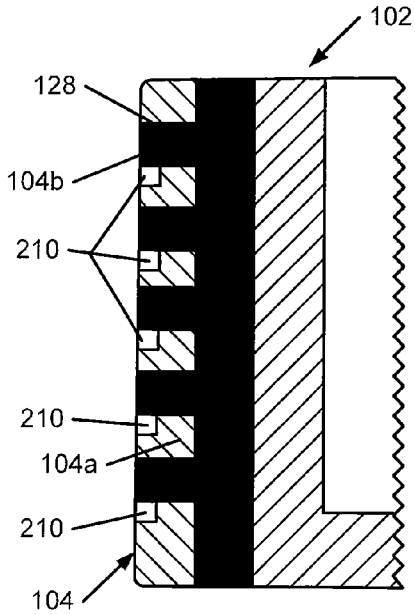

The grooves 210 may have other constructions without departing from this invention. For example, as illustrated in FIG. 2E, the grooves 210 may be formed solely in the material making up the polymeric portion 104*b* of the ball striking surface 104. Alternatively, as illustrated in FIG. 2F, the grooves 210 may be formed solely in the material making up the metal (or other base material) portion 104*a* of the ball striking surface 104. As yet another example, if desired, grooves 210 of the types illustrated in FIGS. 2C, 2D, 2E, and/or 2F may be combined in a single putter head structure without departing from this invention. Also, if desired, in the structures of FIGS. 2E and 2F, grooves 210 may be provided at the tops, the bottoms, or the centers of the polymeric portions 104*b* (FIG. 2E) or the metal portions 104*a* (FIG. 2F), without departing from this invention.

Figure 2G:
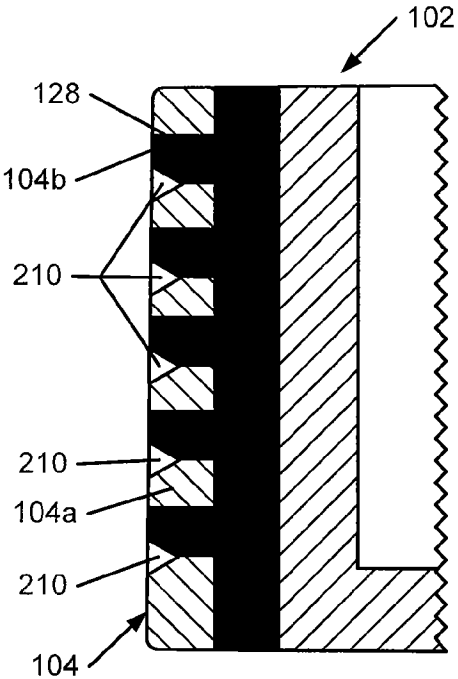

While FIGS. 2C through 2F illustrate grooves 210 have rectangular or "box" shaped cross sections, this is not a requirement. Other groove cross sectional shapes may be used without departing from this invention. For example, as shown in FIG. 2G, in this example structure 102 according to the invention, the grooves 210 have a "V-shaped" cross sectional configuration. While illustrated as being formed in both the metal (or other) base material portion 104*a* and the polymeric portion 104*b* in this example structure, V-shaped grooves of this type may be formed in only one of these portions 104*a* or 104*b* without departing from this invention. In some example structures according to this invention, the top edge of the groove 210 will be defined by the material of one of the portions (e.g., portion 104*b*) and the bottom edge of the groove 210 will be defined by the material of the other portion (e.g., portion 104*a*).

Notably, by making the groove 210 V-shaped, the angle between the front ball striking face and the groove side wall is not as sharp (e.g., more than 90°, and optionally between 120° and 170°, and in some examples, between 135° and 155°). This less sharp angle may grip the ball somewhat less aggressively (as compared to the 90° box shaped grooves 210 of various other figures), to allow fine tuning of the ball's typical launch angle and/or rolling characteristics (e.g., to suit an individual player's preferences, typical course conditions, etc.). While V-shaped and box-shaped grooves 210 are illustrated in these figures, other groove cross sectional shapes also may be utilized, such as C-shaped, non-symmetric shapes (e.g., with the top entry angle into the groove different from the bottom entry angle into the groove), etc. Also, if desired, a single ball striking face may have grooves 210 of different cross sectional shapes (e.g., with some grooves box-shaped, some V-shaped, etc.) and/or grooves 210 with changes in cross-sectional shape over the length of the groove 210.

V-shaped grooves as shown in FIG. 2G and/or other groove cross sectional shapes may be used in any desired putter head construction without departing from this invention, including the various constructions described above and described in more detail below (in conjunction with FIGS. 1A through 7B and FIGS. 9 through 15B). Additionally, if desired, V-shaped grooves as shown in FIG. 2G and/or other groove cross sectional shapes may be used in any of the putter head constructions described in U.S. Pat. Nos. 7,717,801; 7,806,779; U.S. patent application Ser. No. 12/612,236; and U.S. patent application Ser. No. 12/755,330 mentioned above.

Figure 3:
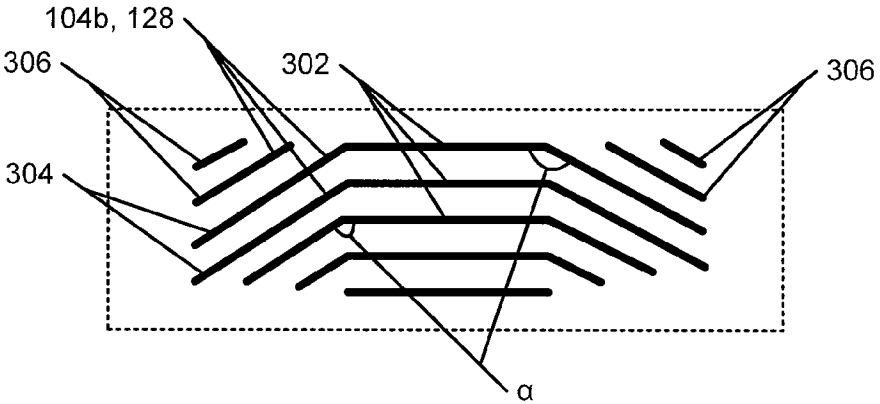
FIG. 3 illustrates additional example ball striking surface features of putter head structures in accordance with aspects of this invention.

The openings 128 on the ball striking surface 104 through which the polymeric material 104*b* is exposed also may have a wide variety of configurations without departing from this invention. FIGS. 1A and 3 illustrate the openings 128 (and thus the exposed polymeric material 104*b*) as a plurality of elongated slots that extend across the central portion of the ball striking surface 104. More specifically, as illustrated in FIG. 3, in the central portion of the ball striking surface 104, a vertically spaced series of generally horizontal linear segments 302 are provided (when the putter is oriented in a ball address position), and on at least some of these horizontal segments 302, slanted, linear, downwardly extending end segments 304 are provided that extend contiguously with the horizontal segments 302. Any desired angle $\alpha$ between the slanted, linear end segments 304 and the horizontal segments 302 may be provided without departing from this invention. In some more specific examples, the angle $\alpha$ may be in the range of 100-170°, and in some structures, between 110-160° or even between 120-150°, and the various angles $\alpha$ within a single putter head may be the same or different without departing from this invention.

In addition, if desired, one or more individual slanted segments 306 may be provided independent of horizontal segments, e.g., at the upper edges of the overall polymeric segment design (running parallel to or substantially parallel to slanted segments 304 associated with a horizontal segment 302). As other alternatives, if desired, the slanted segments 304 and/or 306 may be parallel or non-parallel, may extend upward or downward, may differ in number from those illustrated, may be discontinuous (spaced apart somewhat) from their associated horizontal segment 302 (if any), may all extend downward to a common base line of the putter structure (e.g., to a common horizontal line), may all extend downward to different horizontal locations, etc. In this illustrated structure (as well as the other opening/exposed polymeric material structures described above), grooves may be included in the polymeric material, in the material between the polymeric material, or both, e.g., as described above in conjunction with FIGS. 2C through 2G. The slanted segments 304 and/or 306 (as well as any grooving or scorelines associated therewith), may help keep the ball on the desired line when hit off-center from the ball striking surface.

The presence of contiguous segments is not a requirement. As other examples, the ball striking surface 104 may include multiple sets of separated openings filled with polymeric material. These sets of openings may align with one another or may be offset from one another as one moves across the ball striking surface 104. The sets of openings may extend to a common cavity in the body member, to different cavities, or to no common cavity at all, if desired. Also, if desired, the openings 128 and the exposed polymeric material 104*b* included therein may be oriented at different angles from one another and/or they need not be parallel to one another.

The openings (and thus the exposed polymeric material on the ball striking surface) are not limited to narrow, elongated slots. Rather, if desired, all or some portion of the openings may be of a different shape, e.g., shaped and arranged to produce a stylized design, pattern, alphanumeric information, or other information on the ball striking surface, such as a logo, manufacturer name, brand name, or trademark information, etc. This feature also may be used to customize the putter head, e.g., to include a personal name or initials (such as the putter owner's name or initials), a team name, or any other desired information, or to provide an end user (such as the club purchaser or other person) with the ability to design his or her own putter face.

The overall pattern of exposed polymeric material 104*b* at the putter ball striking surface 104 (and thus the size of the openings 128) may extend and span any desired amount across the ball striking surface 104 in the heel-to-toe direction, such as from 25-100% of the face's heel-to-toe direction, from 30-90% of the face's heel-to-toe direction, or even from 40-80% of the face's heel-to-toe direction. In some example structures in accordance with this invention, the overall pattern of exposed polymeric material 104*b* at the ball striking surface 104 may extend across at least the central 25% of the surface 104 in the heel-to-toe direction, and in some examples, the polymeric material 104*b* will extend across at least the central 40% of the surface 104 or across at least the central 50% of the surface 104 in the heel-to-toe direction.

Figure 4A:
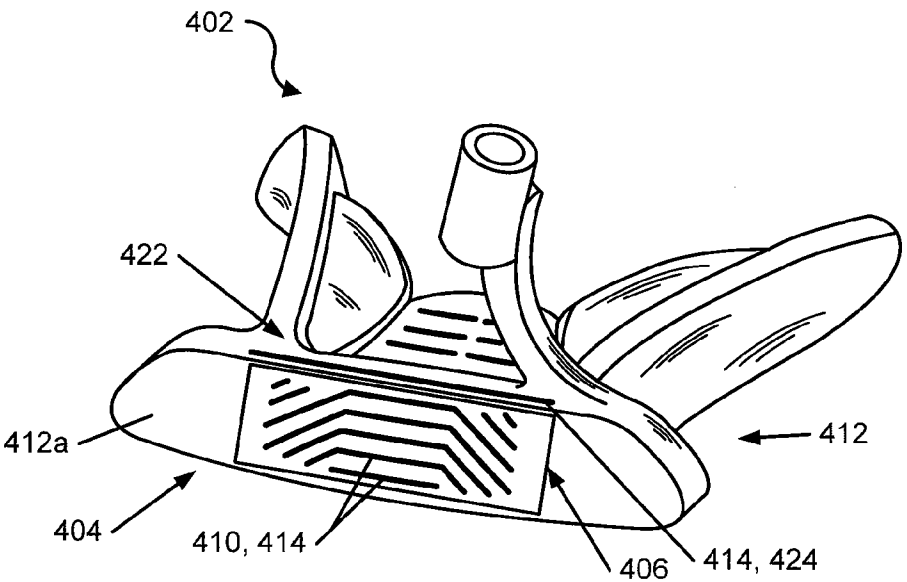
FIGS. 4A through 7B illustrate additional example putter head structures in accordance with aspects of this invention.
Figure 4B:
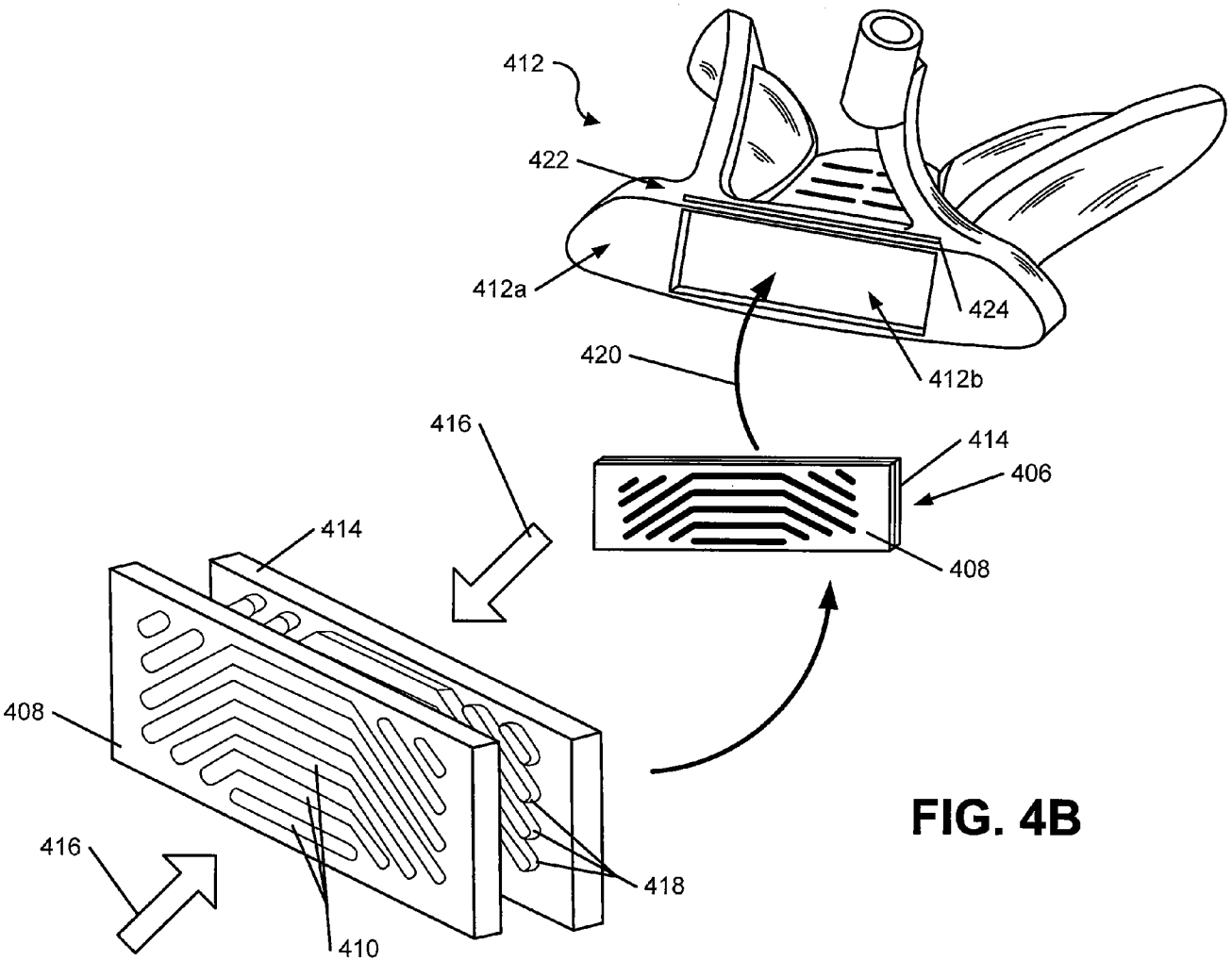

Other putter constructions are possible without departing from this invention, and FIGS. 4A and 4B illustrate another example putter head 402. In the arrangement of FIGS. 4A and 4B, the putter head 402 includes a main putter body portion 412 and an insert member 406 that forms the central portion of the ball striking surface 404. The putter head's ball striking surface 404 is made up of a front surface 412*a* of the putter main body portion 412 and a front surface of the insert member 406. The insert member 406 fits into a recess 412*b* provided in the front surface 412*a* of the putter main body portion 412.

In at least some examples, the insert 406 may include a front plate portion 408, into which openings of any desired sizes, configurations, shapes, etc. may be machined or otherwise formed. In some examples, the plate 408 may be between 1 mm and 4 mm thick and, in some examples, may be approximately 2 or 3 mm thick. As mentioned, the plate 408 may include openings, such as channels 410, formed therein. The openings 410 may, in some arrangements, extend completely through the plate 408 (i.e., forming one or more through holes in the plate 408), or they may extend partially through the plate 408. Additionally or alternatively, the openings 410 may have a constant depth, width, height, etc. across the plate 408. However, in some examples, the depth, width, height, etc. of one or more openings 410 may vary along the length of the opening 410, along the plate 408, and the like. Additionally or alternatively, the openings 410, or at least some portion thereof, may be arranged generally horizontally across the ball striking surface 404 of the putter head 402 when the club is in a ball address position. In other arrangements, the openings 410 may extend in a non-horizontal linear, circular, semi-circular, or other curved pattern on the face.

The plate 408 may be formed of any suitable material, including metals such as aluminum, steel (e.g., stainless steel), titanium, nickel, beryllium, copper, combinations or alloys including these metals; polymers; and the like. Once the openings 410 are formed in the plate 408, the plate 408 may be pressed together (optionally "co-molded") with a moldable, polymer material backing 414, such as thermoplastic polyurethane or thermoset materials. In some examples, the polymer material 414 in the final putter structure (once cured, if necessary) may have a hardness range between 25 and 85 Shore D. In some more specific examples, the polymer material backing 414 may have a hardness range between 35 and 45 Shore D, 50 and 60 Shore D or 60 and 70 Shore D. Forcing the polymer material 414 together with the front plate 408 (for example, as indicated by arrows 416) may be used to form the insert 406 (as shown in FIG. 4B) having polymer material 414 filling the openings 410 formed in the plate 408 to provide a ball striking surface 404 having both metal and polymer contacting the ball. The surface of the polymer backing material 414 may be pre-formed with projections 418 to fit into openings 410, and/or the polymer material 414 may be soft and pliable enough to be forced into the openings 410 during the pressing operation (and optionally later hardened or cured). If necessary or desired, the plate 408 and polymer material 414 may be held together using an adhesive or cement (e.g., double sided tape), mechanical connectors, etc. This combination of metal and polymer materials on the ball striking surface 404 may provide improved performance of the putter including softer feel, increased spin rate, truer roll, a more metallic ball striking sound, etc.

In some examples, during the pressing or co-molding process, the front surface of the plate 408 (which will correspond to a portion of the ball striking surface 404 of the putter head 402) may be held against a mold surface so that grooves (e.g., grooves 210) may be formed in the polymer material (e.g., as described above in conjunction with FIG. 2E). Optionally, if desired, some portion of the grooves may be cut into the metal portion at the location of the openings 410 either before or after the co-molding or pressing process (or other engagement of the plate 408 with the polymer material 414). Alternatively, if desired, the grooves may be cut into the polymer material 414 and/or the metal of the plate 408 after the insert 406 has been made.

As noted above, the putter main body 412 may include a recess 412*b* formed in the front face 412*a* thereof, and this recess 412*b* may be formed in any desired manner. For instance, the recess 412*b* may be milled or otherwise machined into the front face 412*a* during manufacture, or the front face 412*a* may simply be formed into the desired shape, e.g., formed during a molding, casting, forging, or other fabrication operation to include the recess 412*b*. The insert 406 may be shaped to correspond to the shape of the recess 412*b* and may be configured to be received in the recess 412*b* (e.g., as shown by arrow 420). The insert 406 may be engaged with or connected to the recess 412*b* and/or the main putter body portion 412 in any desired manner, such as via adhesives and cements (e.g., double sided adhesive tape); via fusing techniques (e.g., welding, soldering, brazing, etc.); via mechanical fasteners or connectors (including releasable mechanical connectors); and the like. If desired, the insert 406 may rest on or press against a ledge or other structure defined in the recess 412*b* (e.g., along the side, top, and/or bottom edges of the recess 412*b*).

In some examples, the insert 406 may be removable to allow for replacement, customization, and/or personalization of the insert 406 and/or putter head 402. For instance, the insert 406 may be releasably connected to the putter main body portion 412 using mechanical connectors to secure the insert 406 in the recess 412*b* (e.g., screws, bolts or other connectors may extend from a rear side of the putter head toward a front region of the putter head to engage threaded regions provided on the insert 406, it may be engaged from the bottom surface of the putter head upward, it may be engaged from the top surface of the putter head downward, etc.). Personalization and customization features may include various characteristics such as polymer and/or metal color (e.g., team colors, color associated with a cause or promotion, player preference, etc.); polymer and/or metal hardness (e.g., harder or softer for different play conditions or swing types); graphics on the polymer and/or metal (e.g., logos, etc.); alphanumeric or textual information; etc.

In some arrangements, the metal plate 408 may be replaced by a plate formed of a polymer of a different hardness from the backing material polymer 414, thereby forming an insert 406 of all polymer. For instance, the metal plate 408 may be replaced with a plate formed of a polymer material having a higher Shore D hardness value than the polymer 414 filling the grooves 410 of the insert 406. This "all polymer" insert may aid in further reducing weight associated with the putter head 402. Additionally or alternatively, the polymer material 414 may be replaced with a metal of a different hardness from the metal plate 408, thereby forming an insert 406 of all metal.

If desired, the major interior surface defining the recess 412*b* may be formed to include a polymer or other material, to provide a consistent backing or base against which insert 406 is mounted. As another alternative, if desired, the material of the polymer backing layer 414 may be included in the recess 412*b* and the putter head 402 may be formed by pressing plate 408 against the polymer backing material 414 in the recess 412*b* to force the polymer material 414 into the openings 410 of the plate 408. If necessary, one or more overflow holes may be provided at appropriate locations to allow any excess polymer material 414 to escape from the putter head during the pressing operation.

In some examples, the polymer included in the recess 412*b* (if any) may be a material different from the polymer material 414 filling the openings 410 of the insert 406. For instance, polymers of different Shore hardness values may be used for the polymer in the recess 412*b* and the polymer 414 filling the openings 410. In some examples, the polymer 414 filling the openings 410 may have a higher Shore hardness than the polymer in the recess 412*b*. The harder polymer 414 in the openings 410 may aid in creating top spin on the ball (e.g., when the ball is hit with an upward stroke trajectory) while the softer polymer in the recess may aid in providing a soft or consistent "feel" for the putter head 402 (e.g., by damping vibrations).

As further shown in FIGS. 4A and 4B, the top surface 422 of the putter main body 412 may include a window or opening 424 through which the polymeric material 414 is exposed, e.g., to form an alignment aid for the putter head 402, e.g., as described above. The polymeric material 414 exposed in the window 424 may be recessed somewhat as compared to the top surface 422 of the main putter body portion 412 around the window 424, flush with the top surface 422, or raised above the top surface 422. As additional potential features, the pressing action of engaging the plate 408 within the opening 412*b* may force polymeric material 414 up into the window 424 or the window 424 may be filled separately with polymeric material 414. As another example, if desired, the window 424 could be used to inject polymeric material into the recess 412*b* after the plate 408 is fit within the opening 412*b*. This type of window member 424 may be provided in other embodiments of the putter head described herein.

Alternatively, if desired, an insert structure similar to that of FIGS. 4A and 4B could be provided but with the front plate portion 408 formed of a polymer material and with metal material (or a different polymer material, of different hardness) filling the grooves 410. The multi-material face (e.g., polymer and metal at the ball striking face) may be provided, for example, in any of the various methods and using any of the structures described in the patents and patent applications mentioned in the "Related Application" section above.

Figures 5A, 5B, 5C:
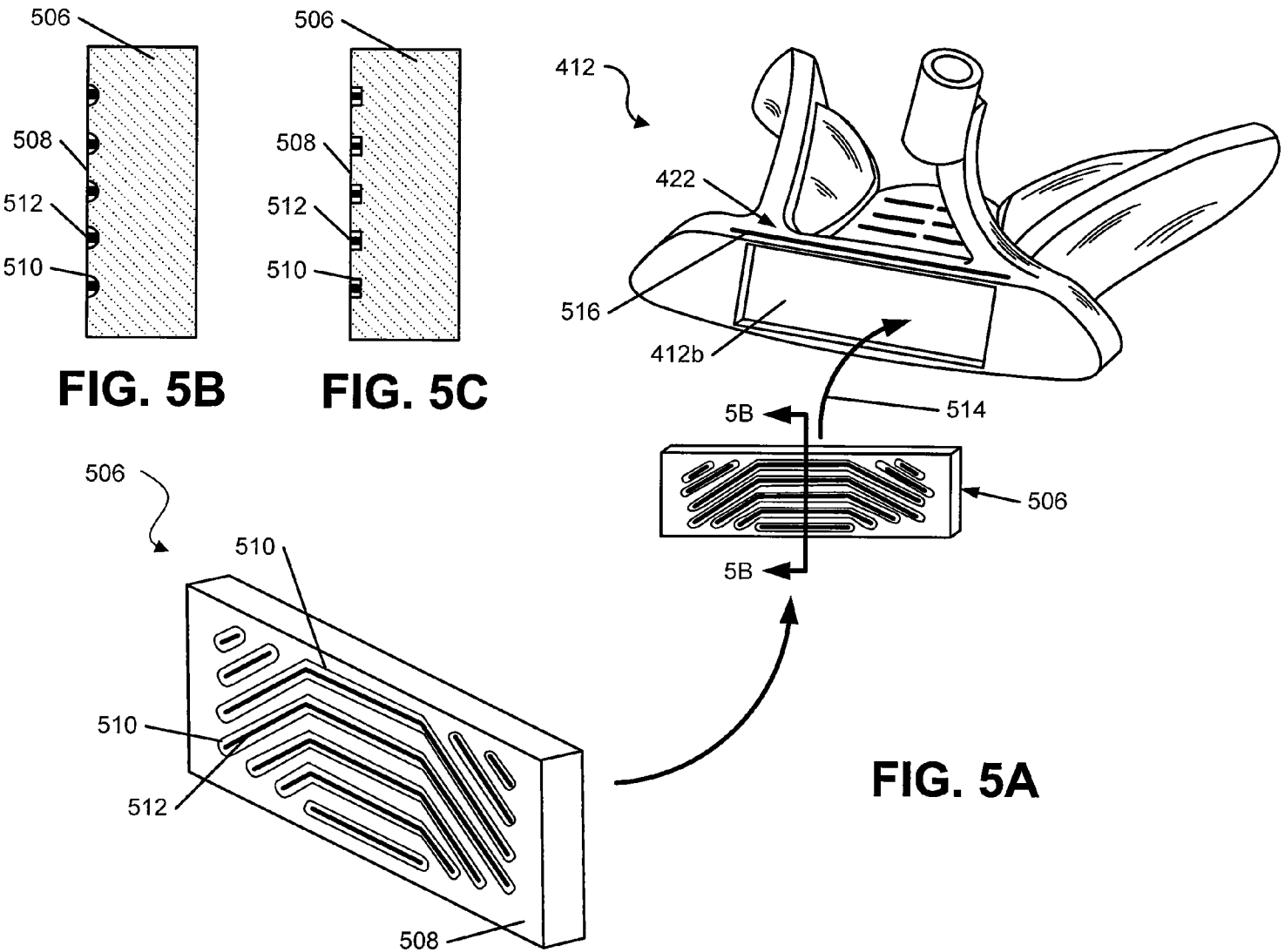

FIGS. 5A through 5C illustrate additional insert arrangements for a putter's ball striking face that may be used according to some example aspects of the invention. In these example arrangements, the insert 506 may be formed of plastic (polymer, e.g., thermoplastic polyurethane, thermoset polyurethanes or other polymers, etc.), and it may include recesses 510 formed therein. The recesses 510 may be cut or machined into the face of the insert 506. However, as shown in FIGS. 5B and 5C, the recesses 510 may not extend completely through the insert 506. Rather, the recesses 510 may be formed in the polymeric surface 508 of the insert 506.

In some examples, a thin metal bar, strip or other metal layer 512 is formed or laid within the recesses 510. FIG. 5B is a cross section of one example insert 506 taken along line 5B-5B of FIG. 5A illustrating this recess 510 and metal strip 512 arrangement. The metal bars or strips 512 may be formed of any suitable metal, including aluminum, titanium, steel, nickel, beryllium, copper, combinations or alloys including one or more of these metals (including stainless steel), etc. In some examples, the thin metal bars 512 may be positioned in a center of the recess 510 formed in the polymer insert 506. The metal strips 512 and recesses 510 formed in the insert 506 may include edges, e.g., sharp edges, that may function as, or similarly to, grooves 410 provided in other arrangements described above. The metal strips 512 may be dimensioned and arranged so that their base exterior surfaces are flush or substantially flush with the main base exterior surface 508 of the insert 506. While FIG. 5B shows an insert 506 with "C-shaped" recesses 510 (in cross section), this is not a requirement. Other cross sectional shapes are possible without departing from this invention, such as the box-shaped recesses 510 shown in FIG. 5C. V-shaped recesses, non-symmetrical recesses, or any other desired recess shape may be provided without departing from this invention. Also, if desired, a single insert 506 may have recesses 510 of different cross sectional shapes.

The metal strips 512 may be provided within the recesses 510 and/or connected to the polymer insert 506 in any desired manner. For instance, the metal 512 may be engaged with the insert 506 via adhesives or cements, mechanical connectors, deposition techniques, etc. The metal strips 512 also may be interconnected with one another and mounted on a rear surface of the main base portion of the insert 506 such that the front of the strips 512 extend to and project through openings in the insert 506 and are exposed at the front surface 508.

Insert 506 may be engaged with the main putter body portion (e.g., portion 412) (as indicated by arrow 514) using various engagement or connection techniques as described above. For instance, the insert 506 may be connected to the recess 412*b* and/or other portion of the main putter body portion 412 via adhesives (e.g., double sided adhesive tape), fusing techniques, mechanical connectors, and the like.

Optionally, if desired, a rear or back side of the insert 506 may include a similar groove and metal strip structure, thus forming a two-sided, reversible insert. The rear or back side insert arrangement may optionally include a different groove pattern or configuration, different metal type, different polymer type, different hardnesses, etc. in order to provide different sound, feel, hardnesses, etc.

In still other arrangements, the metal and polymer may of insert 506 be reversed to provide an insert 506 having an opposite arrangement. For instance, the main base portion of the insert 506 may be formed of a metal (e.g., aluminum, titanium, steel, nickel, beryllium, copper, combinations or alloys including these metals, etc.) and may have a plurality of recesses 510 formed in a surface of the insert 506. Strips of polymer 512 may then be positioned within the recesses 510, such as in a center of the recesses 510. The edges of the metal recesses 510 and the edges of the polymer strips 512 may then act as grooves or scorelines, similar to other arrangements described herein.

In the example structure shown in FIG. 5A, the main putter body portion 412 does not include a window 424 on the top surface 422 as described above in conjunction with FIG. 4B. Rather, in this example structure, an alignment aid 516 is formed on the top surface 422. This alignment aid 516 may be formed in any desired manner, such as by painting, printing, etching, grinding, machining, etc. If desired, this type of top surface alignment aid 516 may be provided in any of the other embodiments of the putter head described herein.

Figure 6B:
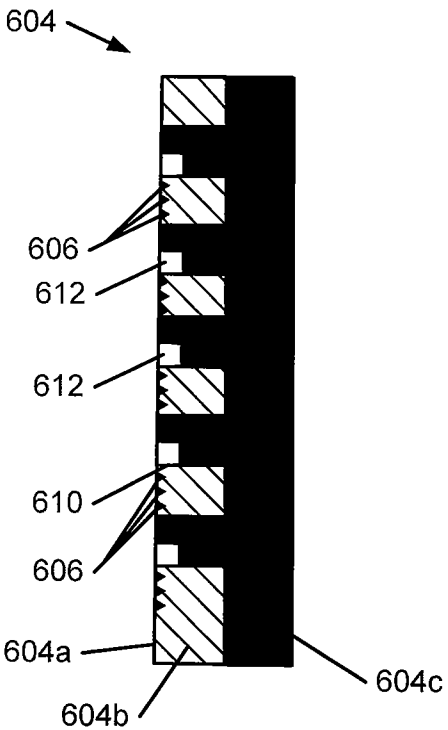
Figure 6A:
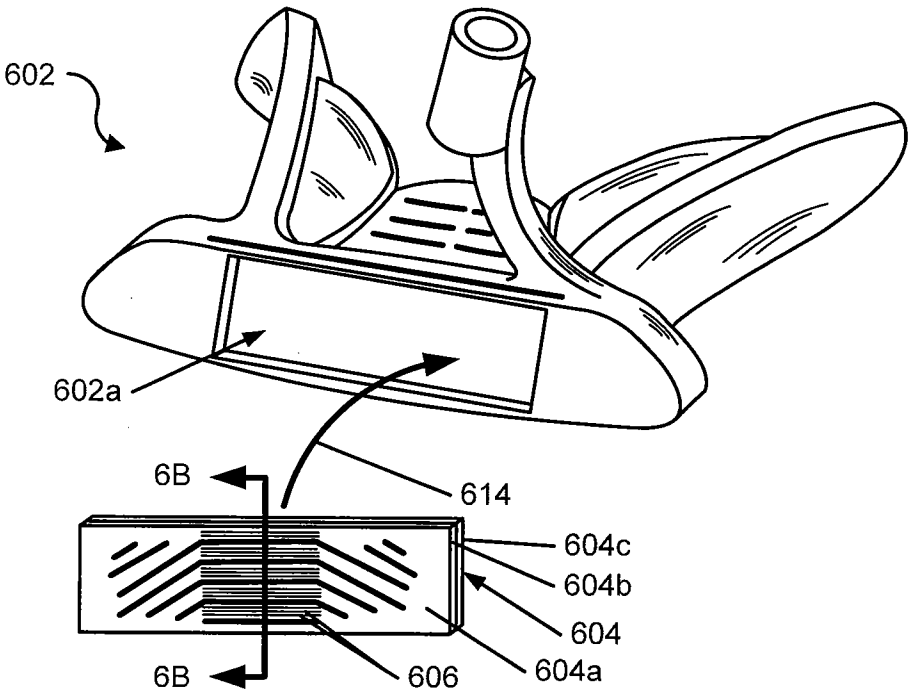

FIGS. 6A and 6B illustrate additional example features that may be included in any of the putter head structures described herein. FIG. 6A illustrates an example putter head 602 having an insert 604, e.g., according to any of the above described arrangements. In this arrangement, the ball striking surface 604*a* of the insert 604 includes a plurality of microgrooves 606 formed between the polymer filled openings 610. In some examples, the microgrooves 606 may be about 1 micron to 1 mm wide and/or deep. The microgrooves 606 may be cut into the metal or polymer base material of the insert 604 in any desired manner, such as by using a laser. Any number of microgrooves 606 may be cut into the metal or polymer base material, and the microgrooves 606 may have any desired curvature, cross section, shape, relative arrangement or orientation, etc. Further, the microgrooves 606 may be cut into the area between some or all adjacent sets of the larger openings 610 or, alternatively, the microgrooves 606 may be cut in any other desired areas.

FIG. 6B is an enlarged cross section of the insert 604 taken along line 6B-6B in FIG. 6A. The insert 604 of this illustrated example includes a ball striking face member 604*b* (e.g., made from metal) and a backing portion 604*c* that may be a polymer, such as thermoplastic polyurethane or thermoset materials, or a metal, such as aluminum, titanium, steel, nickel, beryllium, copper, combinations or alloys including these metals, etc. Similar to some arrangements described above, the ball striking surface 604*a* includes a plurality of grooves 612 cut into it (e.g., into the ball striking face member 604*b*, into the backing portion 604*c*, or partially into both portions 604*b* and 604*c*). The plurality of microgrooves 606 cut into the ball striking surface 604*a* between the larger groove areas 612 also is shown in FIG. 6B. As mentioned above, any number of microgrooves 606 may be cut into the insert 604 within the areas provided between the adjacent larger groove areas 612 (e.g., 2, 3, 4, 5, or more microgrooves 606).

The insert 604 may be engaged with the putter head 602 (as indicated by arrow 614) using any of the techniques and/or methods described above. For instance, the insert 604 may engaged with the club head 602 at recess 602*a* using adhesives (e.g., double sided adhesive tape), fusing techniques, mechanical connectors, etc. Also, microgrooves 606 of the types described above also may be used in conjunction with any of the arrangements and ball striking surfaces described herein.

Figure 7A:
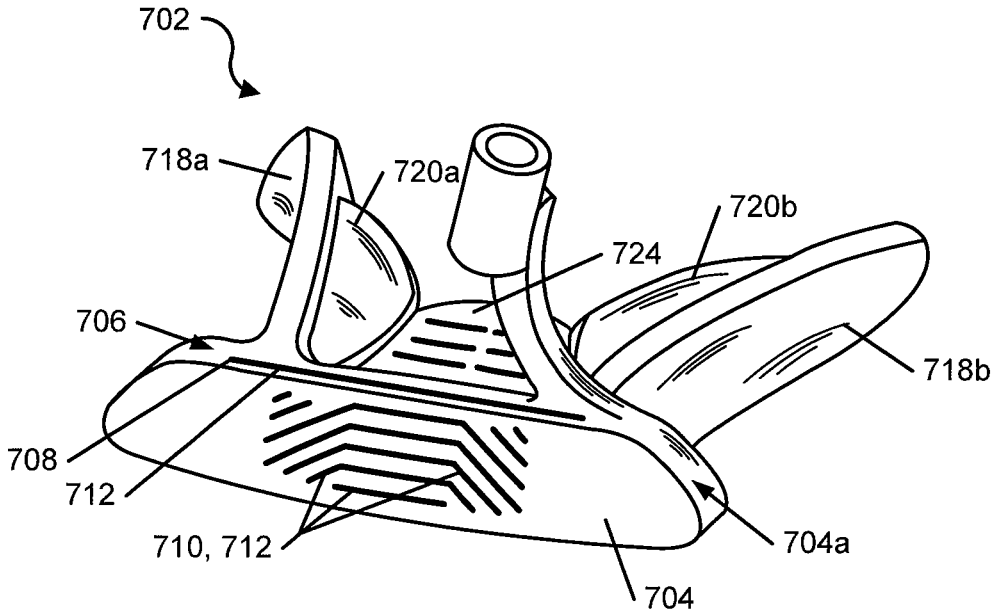
Figure 7B:
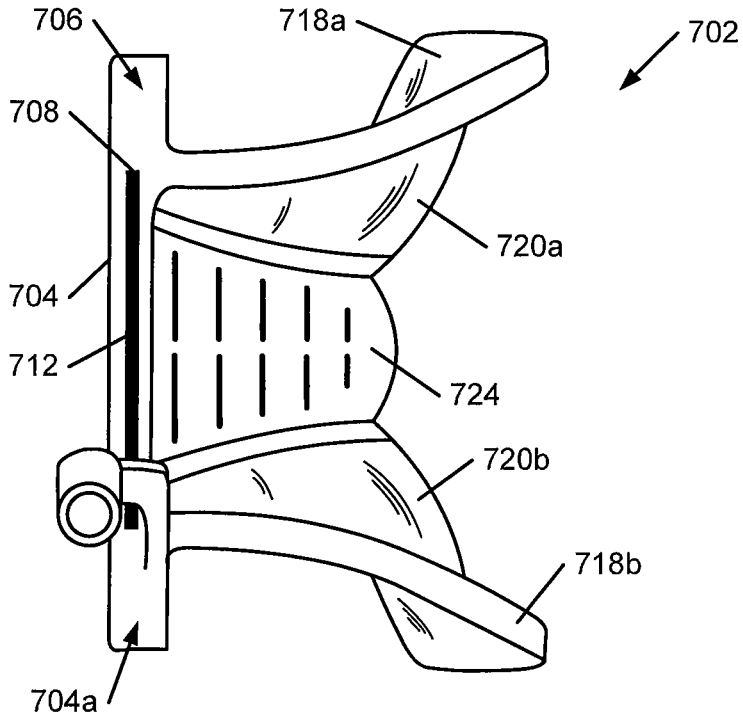

FIGS. 7A and 7B illustrate another example putter head structure 702 in accordance with this invention. In this example structure, at least the ball striking face portion 704*a* of the putter head 702 is comprised of a single piece of material, and if desired, the arm portions 718*a* and 718*b* and/or the intermediate surface portion 724 may be integrally formed with and extend rearward from the ball striking face portion 704*a*. The ball striking face portion 704*a* may have a recess machined into it so that a recess is formed behind the ball striking surface 704. This recess may be machined into the ball striking face portion 704*a* and leave an opening 708 at an exterior of the ball striking face portion 704*a*, e.g., at the top surface 706 in this example structure. Openings 710 also may be machined into the front of the ball striking face portion 704*a*, and these openings 710 may extend to and open into the recess inside the putter ball striking face portion 704*a*. The recess may be filled with polymeric material 712 such that the polymeric material 712 is exposed through the top opening 708 and through the ball striking face openings 710. Once cured and in the final product, the polymeric material 712 may be softer than the material (e.g., metal) of the front of the ball striking face portion 704*a* in the areas adjacent and between the openings 710. The ball striking face portion 704*a*, including the internal recess and openings 710, may be made in the manner described, for example, in the patents and patent applications mentioned in the "Related Application" section above, and the ball striking face portion 704*a*, internal recess, and openings 710 may have any of the various features and characteristics described in these "Related Applications." In this manner, the overall ball striking surface 704 includes the material of the ball striking face portion 704*a* and the exposed polymeric material 712 in openings 710.

Also, the ball striking surface 704 may include grooves defined in the material of the ball striking face portion 704*a* and/or the polymeric material 710, e.g., in any of the manners described above in conjunction with FIGS. 2C through 2G. Also, as illustrated in FIGS. 7A and 7B, the arms 718*a* and 718*b* may include polymeric and/or damping elements 720*a* and 720*b*, respectively, engaged therewith, e.g., in any of the various manners described above.

Figure 8A:
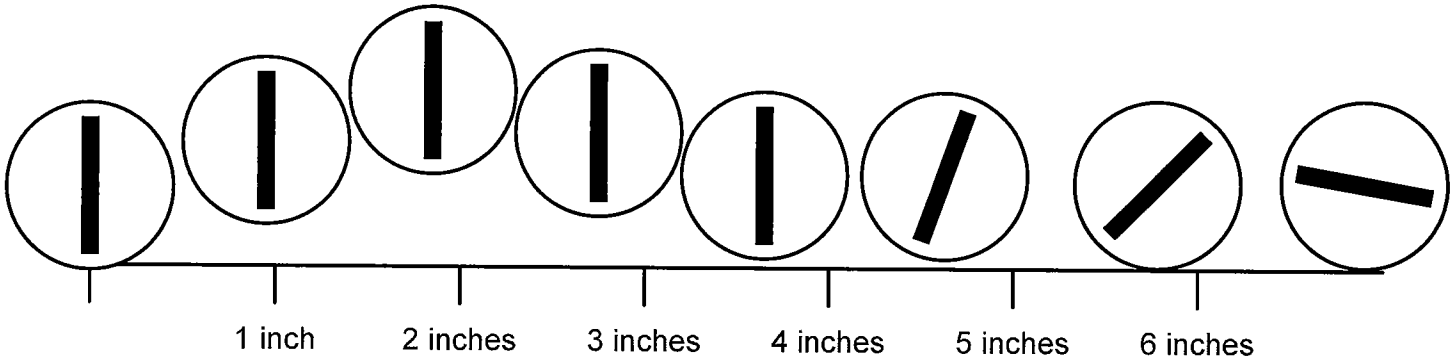
FIG. 8A (Prior Art)
FIGS. 8A and 8B illustrate at least some advantageous features that may be realized in accordance with at least some aspects of this invention.
Figure 8B:
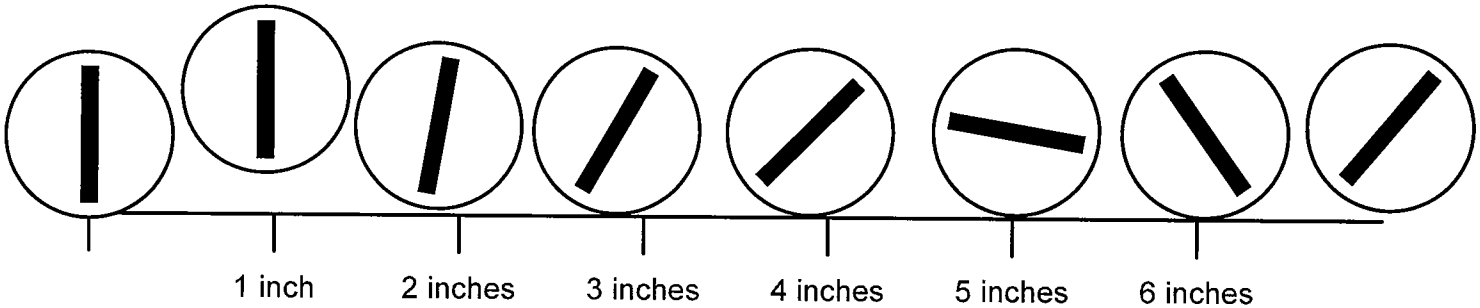

FIGS. 8A and 8B illustrate some example effects of various features of this invention, particularly in the presence of the relatively soft polymeric material at the putter head's ball striking surface (e.g., a thermoplastic polyurethane, which can somewhat grip the ball) and/or a relatively soft ball cover material. More specifically, various advantageous aspects of the invention may be provided or enhanced by including sharp grooves or scorelines in the polymer and/or metal of the ball striking surface (to provide sharp edges on the putter face that can help grip the ball) and by providing a relatively low loft angle on the putter face (e.g., about 2-3° as compared to 4° for conventional putters).

First, as a ball sits on the green, its weight forces it down somewhat into the grass. When putting, the putter must first somewhat "pop" the ball out of this settled condition. Therefore, putter faces generally have some loft to help launch the ball at an upward angle (e.g., angle Θ from FIG. 2B discussed above). This upward angle, however, propels the ball upward (in some instances the ball may actually leave the ground), which causes it to fly or skid across the green before it begins a true roll, as shown in FIG. 8A. This bounce or skid can introduce some inconsistency in speed, because the ball does not always "fly" or "skid" the same amount, and it can end up taking inconsistent amounts of energy off the ball during the transition between the flying and skidding mode to the true rolling mode. In some instances, the loft of the putter's ball striking surface can actually put a small amount of backspin on the ball during its initial movement.

Putter structures in accordance with at least some examples of this invention, however, may provide quicker and truer roll (and thus a more consistent roll) as compared to conventional putters. As noted above, because of the soft polymer materials and the sharp edges in the polymer and metal (e.g., from the grooves), the putter face tends to "grip" the ball a bit better during a putt (particularly if the putt is struck with somewhat of an upward swing or trajectory of the putter head). This helps "pop" the ball out of its settled condition somewhat more easily and tends to better induce top spin on the ball (which tends to keep the ball on the ground and get it rolling somewhat more quickly). Also, these features allow some example putter heads to have a less lofted face angle (e.g., 2° vs. a conventional 4°). Thus, the ball does not tend to launch as high out of the settled condition, causing it to more quickly contact the ground once out of the settled position, and the induced top spin helps hold the ball on the ground and gets it rolling more quickly. A schematic diagram of an example initial trajectory and roll of the ball using an example putter according to this invention is shown in FIG. 8B.

The microgrooves, as described above in conjunction with the arrangement illustrated in FIGS. 6A and 6B, also can enhance the ball grip and impart top spin on the ball.

As shown in a comparison of FIGS. 8A and 8B, putters in accordance with at least some examples of this invention may get the ball rolling much earlier during the course of a putt (e.g., within about 2 inches or less for at least some putters according to the invention vs. at about 4 to 5 inches for conventional putters, e.g., depending on the initial velocity imparted to the ball, putter against ball impact angle, etc.). Moreover, by getting the ball rolling earlier, with less bounce and skid (and the uncertainty introduced into the putt due to these undesired factors), putters in accordance with at least some examples of this invention tend to provide more reliable and repeatable putting distances, putted ball speeds, and distance control.

Also, the combination of metal and polymer on the ball striking surface of the putter provides a nice, soft and consistent feel (optionally controllable by selecting the hardnesses of the various parts) while still providing a more conventional "metal-on-ball" sound (or "click") of conventional putters. This sound feature also is an important part of the "feel" for many golfers, and maintaining this metallic sound helps prevent a more "dead" sound of putting a ball against a full polymer material on a putter face (e.g., as provided in many conventional putters that simply have a polymer ball striking insert).

Any desired polymeric material may be used in the putter head without departing from this invention, including thermoplastic or thermosetting polymeric materials, synthetic rubber type polymeric materials, etc., such as polyurethanes, vinyls (e.g., ethylvinylacetates, etc.), nylons, polyethers, polybutylene terephthalates, etc. Additionally or alternatively, recycled materials, such as recycled polymer materials, may be used in any of the above-described arrangements without departing from the invention. In some examples, portions of the club head, insert, golf club grip, etc. may be formed a recycled material such as regrind. Regrind may include additives used in the formation of portions of the ball striking surface, club head, grip, etc., and this regrind may include finely ground recycled materials. In some examples, the finely ground recycled materials may be recycled footwear materials that may be scraps, shavings, etc. generated during manufacture, defective or used articles of footwear, and the like. The additives may include leather, cotton, thermoplastics, synthetic and natural rubber, millable/partially cross-linked polyurethane, and synthetic fibers. The thermoplastics may include polyamides, polyesters and polyurethanes.

In some examples, the regrind additives may be ground to a desired particle size and added to raw material (such as new polymeric material) to form the desired portions of the club head, grip, ball striking surface, insert, etc. In other instances, the desired portions may be formed entirely of regrind. One advantage of using regrind materials in forming portions of the putter, such as the ball striking surface, grip, insert, etc., is the reduction in waste associated with the manufacture of the articles being ground into regrind and the reduction in first-use materials in manufacturing portions of the putter. The use of recycled materials generally reduces waste that would have consumed landfill space and aids in reducing the carbon footprint of manufacturers. Additional examples of regrind materials, manufacture, etc. may be found in U.S. Pat. No. 5,346,934 to Chriss, entitled "Footwear Additive Made From Recycled Materials," which is incorporated herein by reference in its entirety.

FIGS. 9 through 13B illustrate additional example putter heads in accordance with this invention. These figures illustrate additional examples of alignment aids that may be included in example structures according to this invention. If desired, in all of these putter heads (including those described above), the majority of the visible surface of the club head when the putter head is in the ball address position (e.g., one or more of the main body portion 912, the front ball striking face member 904*a*, the arms 918*a* and 918*b*, the intermediate surface 924, the third arm 930, the hosel 932, and even the polymeric and/or damping elements 920*a* and 920*b* of the putter head 902) may be made from a dark color, such as green (optionally, colored and/or camouflaged to blend in with the color of grass), black, brown, blue, etc., and optionally with a dull or matte finish. The alignment aids (e.g., the intermediate surface alignment aid 926 and the top surface polymeric material 914 may be made from a highly contrasting color, such as white, yellow, orange, fluorescent colors, etc.). These features help the alignment aids stand out and help focus the eye on the alignment aids.

As shown in these figures, in at least some examples of this invention, the intermediate surface 924 alignment aid 926 may have a generally triangular perimeter shape. Even in examples where the alignment aid 926 is a series of line segments (as shown in FIGS. 11 through 13B), the line segments may be positioned so as to generally form an overall triangular shape (an isosceles triangle, in the illustrated examples) wherein one base surface of the triangle is positioned adjacent to the rear surface 922 of the ball striking portion of the club head and parallel to (or substantially parallel to) the exterior ball striking surface 904. Positioning a base side of the generally triangular shaped alignment aid in this manner helps draw the user's eye forward, toward the exterior ball striking surface 904 and toward the ball.

Figure 10:
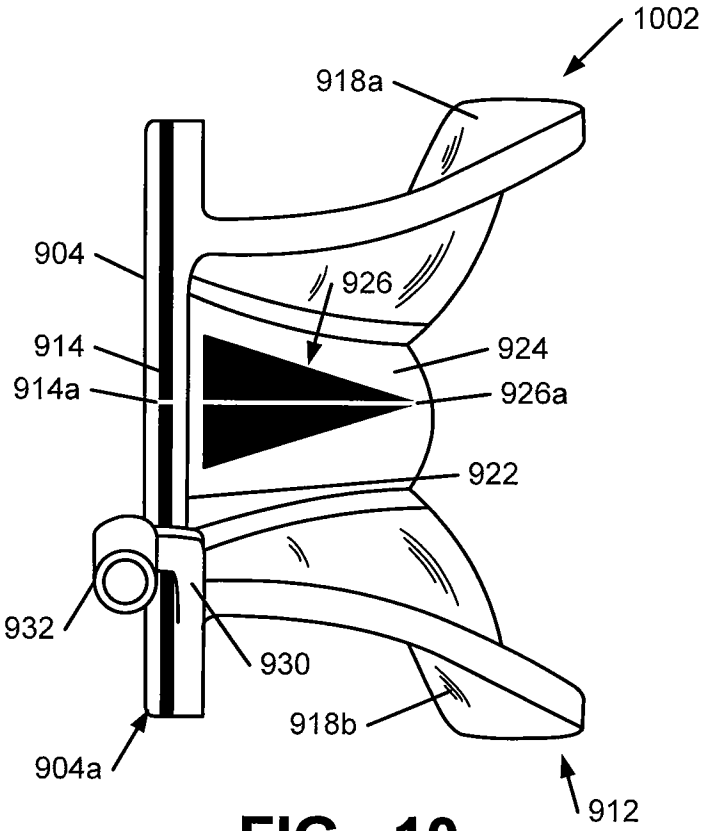
FIGS. 9 through 13B illustrate additional example alignment aids and other potential features of putter head structures in accordance with aspects of this invention.
Figure 9:
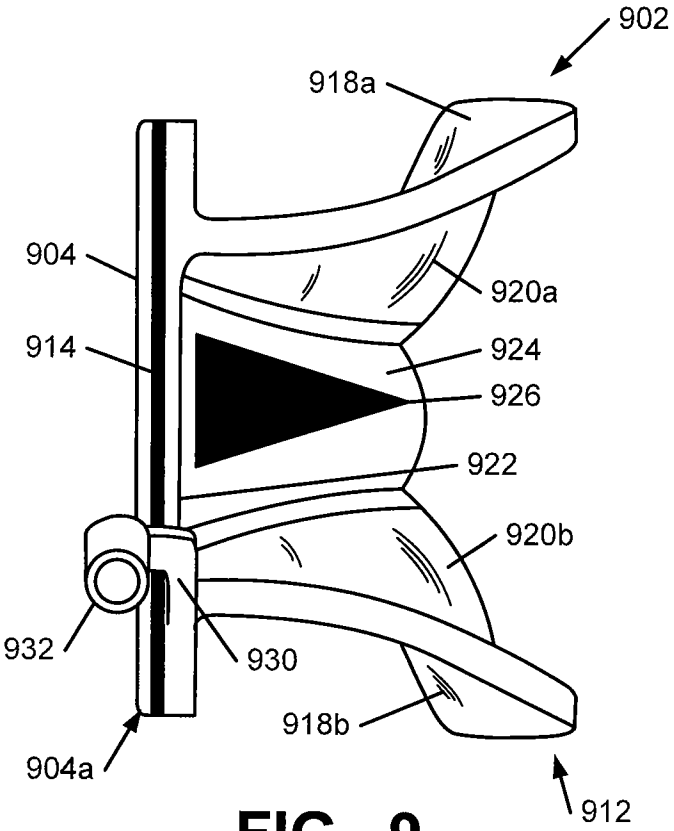

FIG. 9 shows the alignment aid 926 as a substantially solid triangular block. FIG. 10 shows a putter head 1002 with the alignment aid 926 as a similar triangular block but with a center line 926*a* splitting it into two parts (e.g., the alignment aid 926 forms two mirror image right triangles separated by a small space). This center line 926*a* may be colored different from the alignment aid 926, and optionally may be the same color as the intermediate surface 924. If desired, as shown in FIG. 10, the top surface alignment aid 914 may include a similar color change 914*a* that aligns with center line 926*a*. These color change areas 914*a* and/or 926*a* help draw the user's eye and focus toward the putter head's center line.

Figure 12:
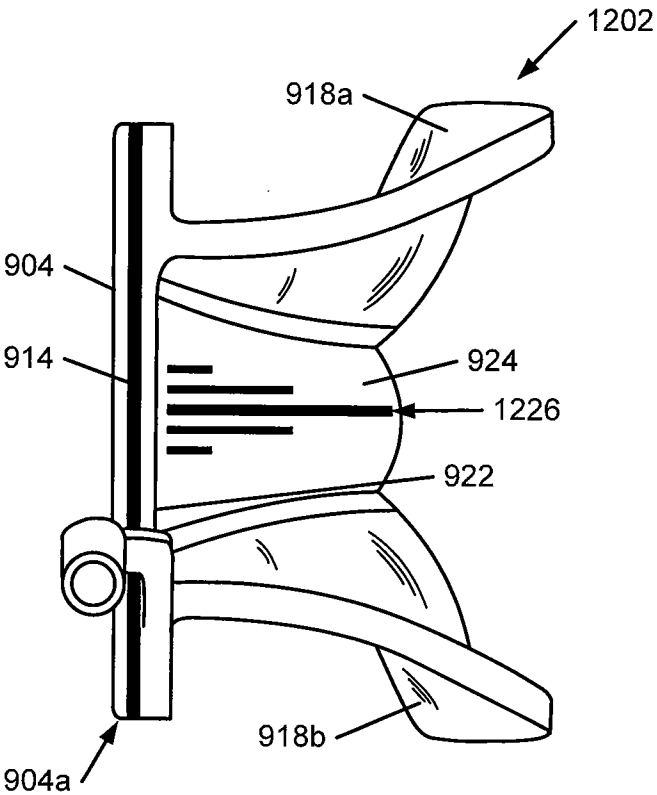
Figure 11:
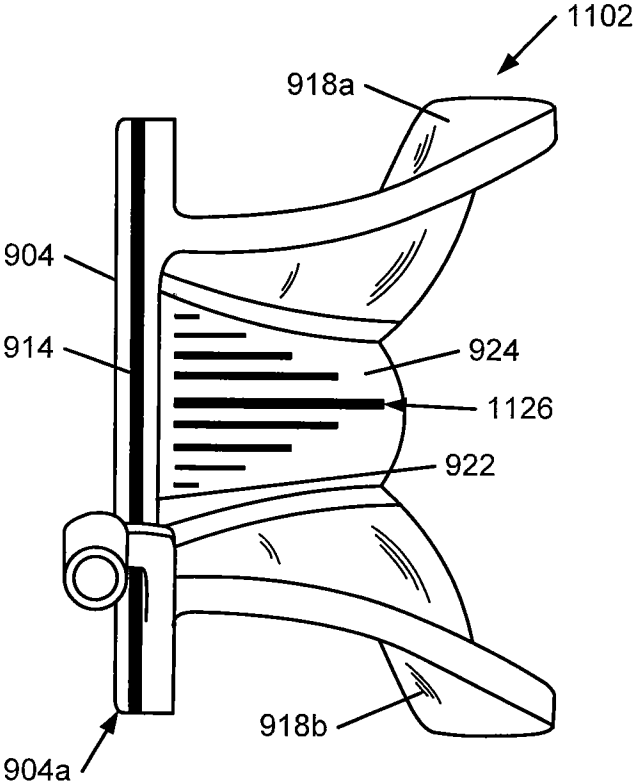

FIG. 11 shows an example putter head 1102 with another example alignment aid 1126 formed as a series of line segments extending in the putter head front-to-rear direction. As shown in FIG. 11, the individual line segments of the alignment aid 1126 get progressively longer from the hosel side of the putter head 1102 to the center (with the center line segment being the longest) and then the line segments get progressively shorter when moving from the center toward the toe side of the putter head 1102. The line segments also extend in parallel. In this manner, the overall alignment aid 1126 has a generally triangular appearance (e.g., a generally isosceles triangular perimeter). The alignment aid 1226 in the putter head 1202 of FIG. 12 is similar to that of FIG. 11, but with fewer line segments.

Figure 13B:
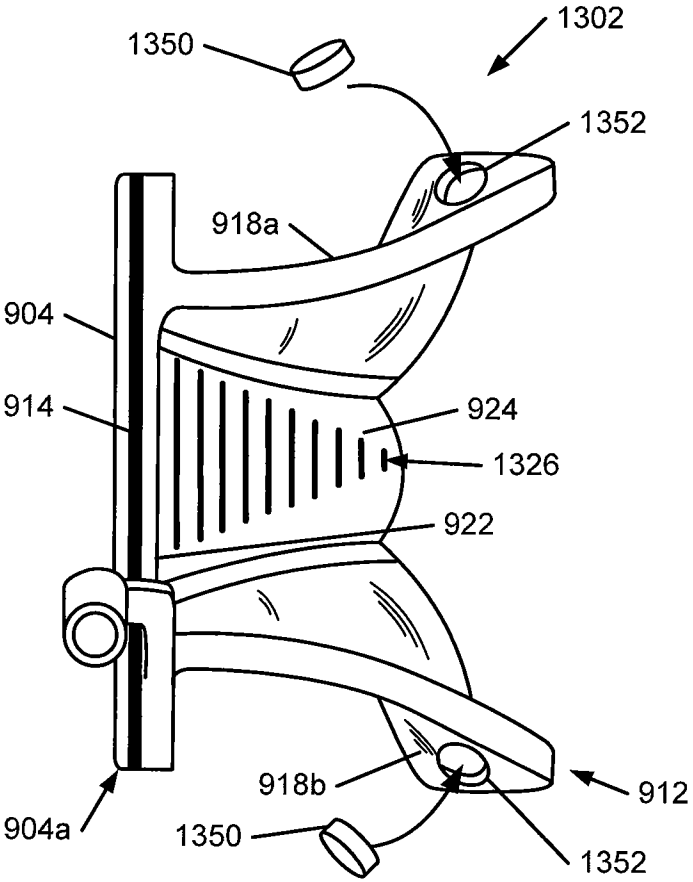
Figure 13A:
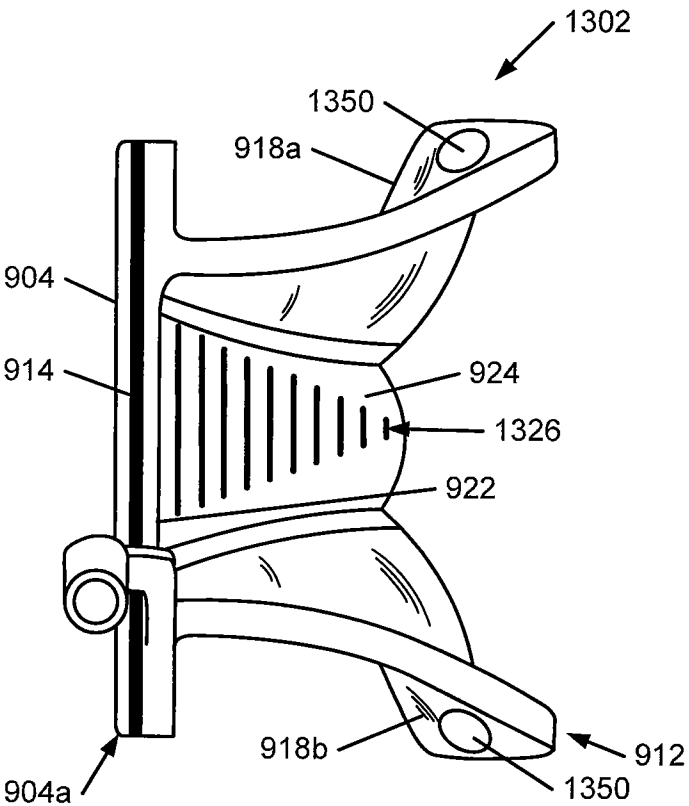

FIGS. 13A and 13B show an example putter head 1302 having another example alignment aid 1326 formed as a series of line segments, but these line segments extend in the putter head 1302 heel-to-toe direction. As shown in FIG. 13A, the individual line segments of the alignment aid 1326 get progressively shorter from the rear surface 922 of the ball striking face member 904*a* to the rear of the intermediate surface 924. The line segments also extend in parallel. In this manner, the overall alignment aid 1326 has a generally triangular appearance (e.g., a generally isosceles triangular perimeter).

Those skilled in the art will appreciate, given benefit of this specification, that the alignment aids of FIGS. 9 through 13A may be used in any of the desired club head structures mentioned above, without departing from this invention.

FIGS. 13A and 13B illustrate another example feature that may be included in putter structures according to this invention, if desired. In the arrangements described above, the polymer material may be generally a lightweight material relative to various metals that may be used in other portions of the putter constructions. Accordingly, the use of a polymer in some or all of the putter head construction aids in reducing the overall weight associated with the putter head. This reduction in weight may also permit redistribution or repositioning of weight associated with the putter head. For instance, additional weight may be added or shifted to various regions of the putter head in order to alter the physical and performance characteristics of the putter head.

In one example, it may be desirable to reposition the weight saved by using the polymeric material in the putter head to various other locations within the club head structure, such as rearward and toward the side edges of the putter head (e.g., to increase the club head's moment of inertia, particularly the Izz moment (about a vertical axis through the club head's center of gravity)). The example putter head 1302 of FIG. 13A includes one or more weights 1350, formed of a denser or heavier material than at least portions of the remainder of the putter head 1302, such as tungsten, lead, or materials containing tungsten or lead, arranged on the rear of the arms 918*a* and 918*b* of the putter head 1302. In some examples, as shown in FIG. 13B, the weights 1350 may be removable and/or interchangeable with weights that may be heavier or lighter than the original weights 1350, for customization and/or personalization features. These weights 1350 allow control and customization of the putter head's center of gravity location, weight, feel, moment of inertia, etc.

The weights 1350 may be connected to the putter head 1302 using various techniques. In one example, the weights 1350 may be provided in weight ports 1352 that may include threaded openings in which weights 1350 formed as screws, bolts, or other mechanical connectors may be inserted for holding the weights 1350 in the club head body. See FIG. 13B. Alternatively, the weights 1350 may be permanently engaged with the putter main body portion 912 (e.g., with arms 918*a* and 918*b*), such as by adhesives or fusing techniques, such as welding. The weights 1350 also could be integrally formed as part of the putter main body portion 912 (e.g., as part of arms 918*a* and 918*b*), for example, as heavier or weighted regions formed during the body portion manufacturing process (e.g., during casting, forging, etc.).

Weights 1350 and/or weight ports 1352 of the types described above may be included in any of the putter head constructions described above, e.g., those described in conjunction with FIGS. 1A through 7B and/or FIGS. 9 through 12.

Figure 14B:
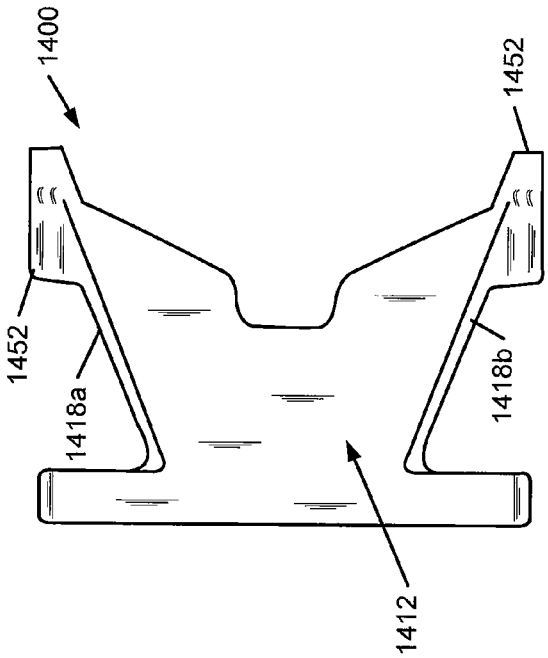
FIGS. 14A through 19 illustrate additional example putter head structures in accordance with aspects of this invention.
Figure 14A:
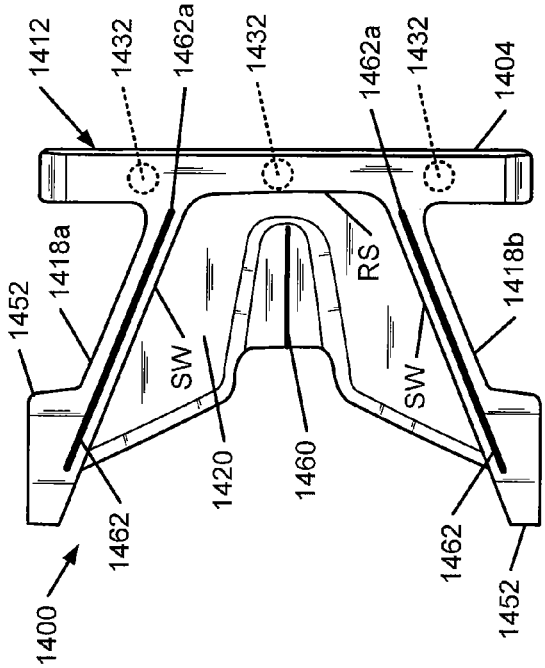
Figure 14E:
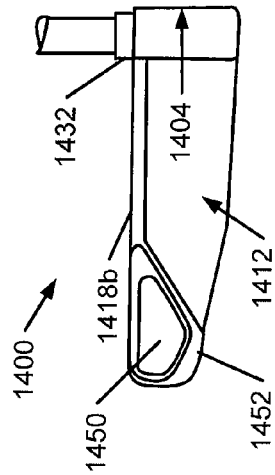
Figure 14D:
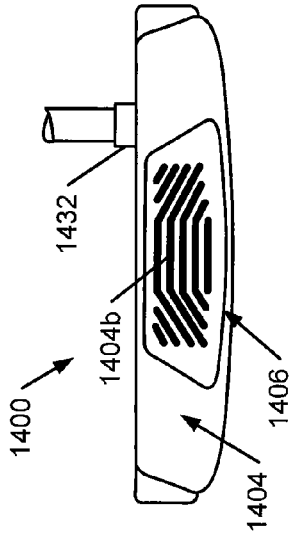

FIGS. 14A through 14E show top, bottom, left side, front, and right side views, respectively, of another example putter head structure 1400 in accordance with at least some examples of this invention. This example putter head structure 1400 is a bit more "square" looking as compared to some of the other example structures described above. Nonetheless, the putter head 1400 still includes a main putter body portion 1412 including a first arm 1418*a* and a second arm 1418*b* extending rearward and away from the ball striking face 1404. A single polymeric member 1420 extends (in this illustrated example structure) from one arm 1418*a* to the other arm 1418*b* (such that one side edge or element of member 1420 contacts one arm 1418*a* and another side edge or element of member 1420 contacts the other arm 1418*b*), although the polymeric member 1420 may be made from one or more independent parts without departing from this invention. As shown in FIG. 14D, the ball striking face 1404 of this illustrated example structure 1400 includes an insert member 1406, e.g., of the types described above in conjunction with FIGS. 4A through 6B (optionally including groove structures of the types shown in FIGS. 2B through 2G), although polymeric material 1404*b* may be exposed at the ball striking face 1404 through machined in openings of the type described above in conjunction with FIG. 7A (optionally including groove structures of the types shown in FIGS. 2B through 2G). The putter head 1400 may be heel shafted or center shafted (as shown by hosel elements 1432) and/or designed for use by right or left handers.

Optionally, if desired, the polymeric member 1420 may extend up on the interior (facing) side walls SW of at least some portion of the arms 1418*a* and 1418*b* and/or on the rear surface RS of the ball striking face. The polymeric member(s) 1420 may help dampen vibrations when a golf ball is struck, as noted above.

Figure 14C:
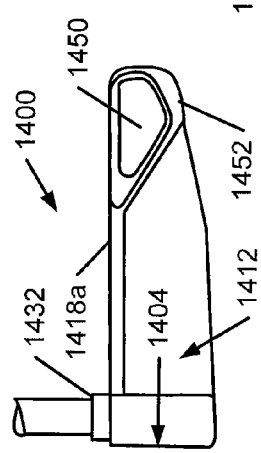

As further shown in FIGS. 14C and 14E, the free ends of arms 1418*a* and 1418*b* may include weight ports 1452 defined therein in which weights 1450 are mounted (optionally in a removable manner, e.g., to allow customization of the putter head to better match a player's putting stroke and/or feel preferences). If desired, the weights 1450 may constitute a lead or tungsten containing material, and optionally lead or tungsten in powder form dispersed in a polymeric base or binder. The polymeric base or binder also may perform at least some vibration damping function.

FIG. 14A illustrates other example alignment aids that can be used in putter head structures in accordance with at least some examples of this invention. As shown, this example putter head 1400 includes three different alignment aid features. A central alignment aid 1460 points in the intended target direction and aligns with the heel-to-toe center of the ball striking face 1404. This central alignment aid 1460 may be provided on the polymeric member 1420 and/or on a top surface of the main body portion 1412 of the putter head 1400 (e.g., depending on the extent to which the polymeric member 1420 covers the top of the putter head's main body portion 1412). Two side alignment aids 1462 are provided along the top surface of the putter main body portion 1412, one aid 1462 on each arm 1418*a* and 1418*b*. These side alignment aids 1462 may be symmetrically oriented at the putter head's top surface, optionally such that their forward ends 1462*a* are spaced apart about a golf ball diameter and/or such that these forward ends 1462 point generally toward the center of the ball (when the putter head 1400 is located in a ball address position and orientation).

Alternatively, if desired, the putter head 1400 of FIGS. 14A through 14E may include other alignment aids, including, for example, any of the other alignment aids described above in conjunction with FIGS. 1A and 9-13B.

Figure 15A:
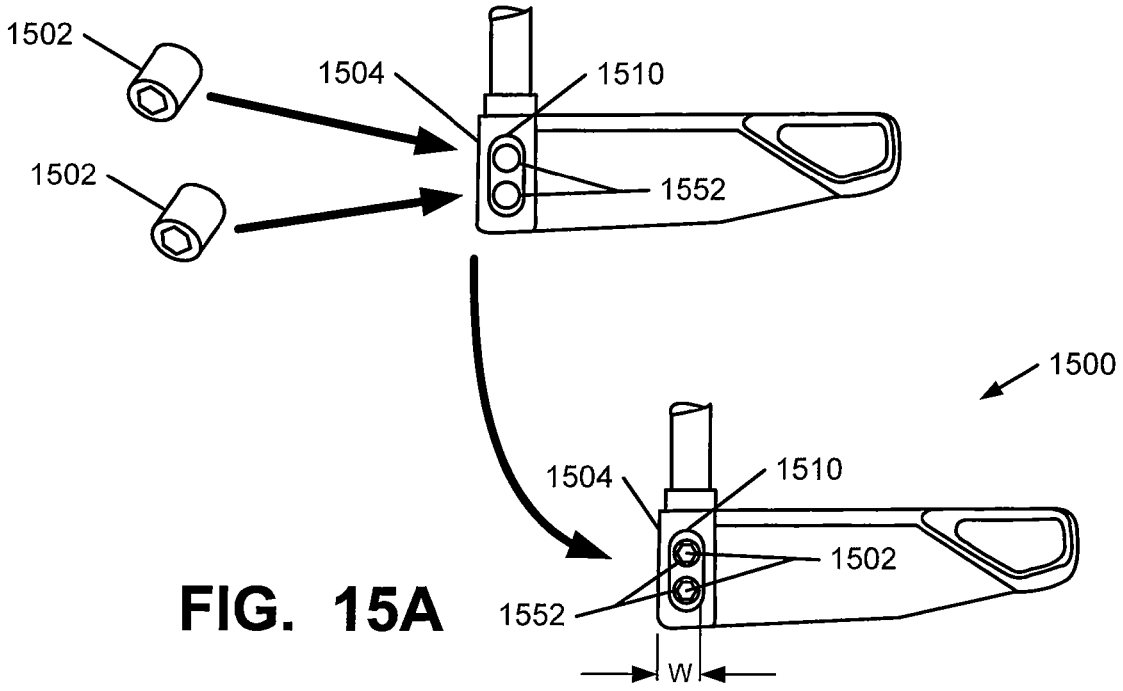
Figure 15B:
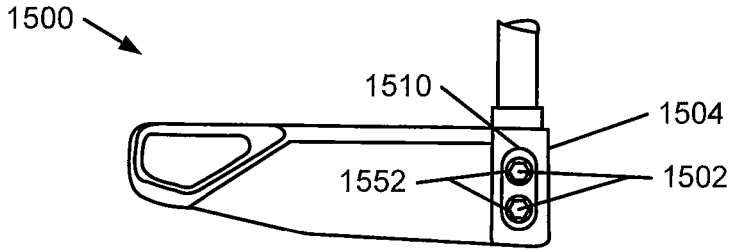

FIGS. 15A and 15B illustrate additional features that may be included in putter heads in accordance with at least some examples of this invention. More specifically, FIGS. 15A and 15B show heel and toe side views, respectively, of a putter head 1500 in which weights 1502 are mounted in the heel and/or toe side edges of the ball striking face 1504 (and close to the ball striking face 1504). As shown in these figures, each of the side edges of the ball striking face 1504 may include ports 1552 in which weights 1502 are mounted. Optionally, if desired, the weights 1502 may be mounted in the ports 1552 in a removable manner, via any desired type of releasable connection, including, for example, mechanical connectors (e.g., threaded connections, turnbuckle type connections, spring-loaded connections, etc.). Also, while two vertically spaced weights 1502 are shown on each side edge of the putter ball striking face 1504 in FIGS. 15A and 15B, any desired number and/or orientation of weights, weight ports, and the like may be provided without departing from this invention. If desired, each port 1552 need not contain a weight 1502 (and indeed, if desired, no port 1552 needs to contain a weight 1502) when the putter head 1500 is used for play. Also, if desired, the weights 1502 and/or weight ports 1552 may be fully contained within 1.5 inches of the very front of the putter's ball striking face 1504 (in the front-to-rear direction, dimension "W" in FIG. 15A), and in some examples, dimension "W" will be 1 inch or less or even 0.75 inches or less.

As further shown in these figures, if desired, the weights 1502 and the ports 1552 therefor may be recessed or countersunk into the putter head structure 1500, optionally, so that the weights 1502 are not visible to the player when the putter head 1500 is being used. This is shown in FIGS. 15A and 15B by the countersink hole 1510. While these figures show a single countersink hole 1510 on each side edge of the ball striking face 1504, any number of countersink holes 1510 may be provided without departing from this invention (e.g., one countersink hole 1510 per side containing all weight ports 1552 on that side, one countersink hole 1510 per weight port 1552, and any combination between these extremes).

If desired, in at least some example structures in accordance with this invention, during manufacture of the putter heads 1500, one or both countersink hole(s) 1510 may form a portion of the machined-in recess formed behind the ball striking face portion, e.g., like the machined-in recess described in the example putter head structure shown in FIGS. 7A and 7B. Then, the polymeric material that is ultimately exposed through and forms a portion of the ball striking face (as described above) may be injected into the putter head through this machined-in recess. A cap or other structure may be provided (if necessary) to close in the polymeric material and/or at least partially close off the recess, and this cap or other structure can provide the structure for the weight port(s) 1552 to which the weight(s) 1502 are mounted. As another alternative, if desired, the weights 1502 may be mounted on an exposed surface of the polymeric material without the need for a separate weight port 1552. One or more cap members also may be provided to cover the weights 1502, the weight ports 1552, and/or the countersink holes 1510.

Weights 1502 and their location close to the ball striking surface 1504 as described above in conjunction with FIGS. 15A and 15B may provide various advantageous features. For example, by placing additional weight out toward the sides of the putter head body, the putter head's moment of inertia about the z-axis (a vertical axis) may be increased, thereby increasing the putter head's resistance to twisting on off-center hits.

Additionally, these features of the invention can help customize or personalize the putter head to help users make better contact with the ball and launch the ball in the desired direction. More specifically, the amount of weight provided in the heel and toe weight ports 1552 can affect the putter head's motion during a putting stroke. As some more concrete examples, for players that tend to hit the ball with an open putter face, more weight can be provided in the putter heel port(s) 1552 to help the putter face close a bit earlier in the putting stroke. Alternatively, for players that tend to hit the ball with a closed putter face, more weight can be provided in the putter toe port(s) 1552 to help the putter face remain open a bit longer in the putting stroke. Adjusting the weighting in the vertical direction can also help fine tune and control the location and/or height of the bottom of the arc of the putting stroke. Club fitters and/or others can use these weights 1502 and weight ports 1552 to help better match a putter head to the user's stroke to provide more consistent, on-line, and straight putting.

Heel and/or toe oriented weights, optionally as part of or very close to the ball striking portion of the putter head (e.g., just back from the ball striking face) as shown in FIGS. 15A and 15B, may be used in any desired putter head constructions without departing from this invention, including the various constructions described above in conjunction with FIGS. 1A through 7B and FIGS. 9 through 14E, as well as in the putter head constructions described in U.S. Pat. Nos. 7,717,801; 7,806,779; U.S. patent application Ser. No. 12/612,236; and U.S. patent application Ser. No. 12/755,330 and/or in the constructions described in more detail below in conjunction with FIGS. 16A through 19.

Figure 16A:
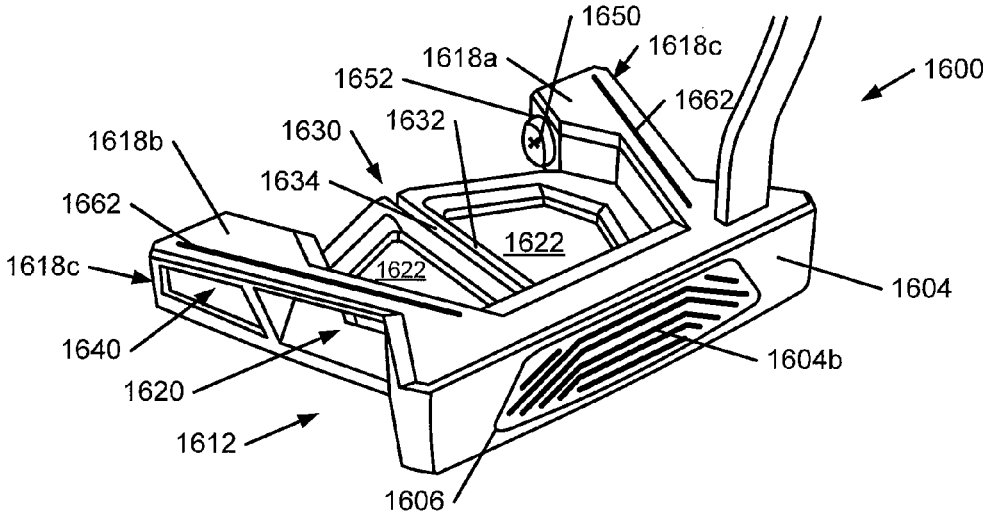
Figure 16B:
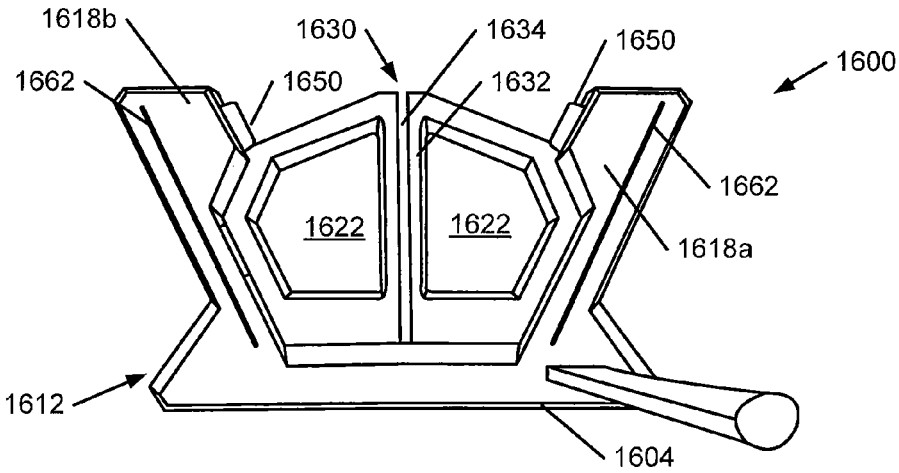
Figure 16C:
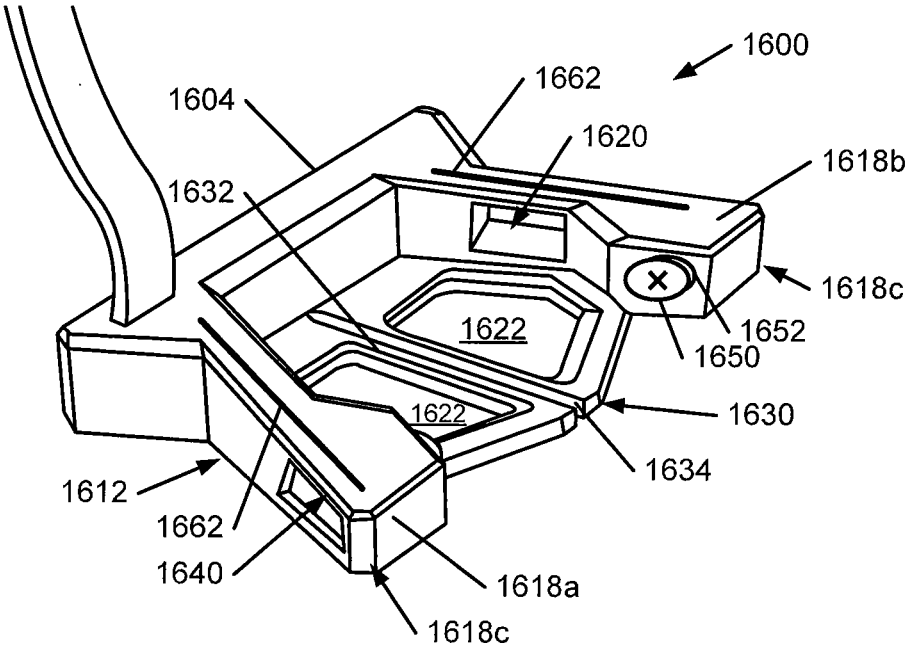

FIGS. 16A through 16C show front perspective, top, and rear perspective views, respectively, of another example putter head 1600 in accordance with at least some examples of this invention. Putter head 1600 includes a ball striking face 1604 and a main putter body portion 1612 including a first arm 1618*a* and a second arm 1618*b* extending rearward and away from the ball striking face 1604 (and away from one another). As shown in FIG. 16A, the ball striking face 1604 of this illustrated example structure 1600 includes an insert member 1606, e.g., of the types described above in conjunction with FIGS. 4A through 6B (optionally including groove structures of the types shown in FIGS. 2B through 2G), although polymeric material 1604*b* may be exposed at the ball striking face 1604 through machined-in openings of the type described above in conjunction with FIG. 7A (optionally including groove structures of the types shown in FIGS. 2B through 2G). The putter head 1600 may be heel shafted or center shafted and/or designed for use by right or left handers.

As further shown in FIGS. 16A and 16C, the free ends of arms 1618*a* and 1618*b* (e.g., optionally at their rearmost location, at their extreme outer edges, the interior sides of the arms, etc.) may include weight ports 1652 defined therein in which weights 1650 are mounted (optionally in a removable manner, e.g., to allow customization of the putter head to better match a player's putting stroke and/or feel preferences). The weights 1650 may be made from materials containing one or more of the following: lead, tungsten, lead alloys, tungsten alloys, lead and/or tungsten doped polymeric materials; other dense metal or other materials.

While the putter 1600 may be made from a variety of different materials without departing from this invention, in this illustrated example, the main putter body portion 1612 may be made from a lightweight metal material, such as aluminum, titanium, alloys containing aluminum and/or titanium, stainless steel, copper, copper alloys, etc. In this illustrated example, the main putter body portion 1612 (including the ball striking face 1604 and arms 1618*a* and 1618*b*) is made from a single piece of material and includes recesses or ports for attachment of the insert member 1606 and the weights 1650. Any overall number of parts and pieces may be provided in such a putter head 1600 without departing from this invention.

One aspect of this putter head 1600 that differs from others described above relates to the inclusion of various openings or holes in the main putter body portion 1612. For example, one or both arms 1618*a* and 1618*b* may include one or more openings 1620 defined through them. Optionally, if desired, both arms 1618*a* and 1618*b* need not include openings 1620 (e.g., the heel side arm 1618*a* may have a closed side wall). The bottom base surface 1630 of this example structure 1600 includes a central ridge element 1632 that in part defines two openings 1622 in the bottom base surface 1630. Any number of openings may be provided in this bottom base surface 1630. A central alignment aid 1634 is provided along the central ridge element 1632 to provide a portion of an alignment aid for this putter structure 1600. This central alignment aid 1634 may be provided as a raised surface (raised from central ridge element 1632), as a recessed surface (recessed into central ridge element 1632), or it may constitute a gap between two sides of the central ridge element 1632 (exposing the ground between the two sides of central ridge element 1632). If desired, rather than complete openings through the putter head 1600, areas 1620 and 1622 in FIGS. 16A through 16B may represent areas of reduced material thickness.

The various openings 1620 and 1622 (or reduced material thickness areas), when present, further reduce the weight of the main putter body portion 1612. This weight savings enables a user, club fitter, club manufacturer, or the like, to reposition weight to other locations on the club head body 1612, such as in the weight ports 1652. Selective weighting and weight positioning can increase the putter head's moment of inertia, particularly about a vertical axis (e.g., through the putter head's center of gravity, at the center of the ball striking face, etc.), which reduces the tendency for the putter head 1600 to twist, even if the ball is hit at somewhat of an off center position on the putter face.

In addition or as an alternative to the weight ports 1652 and weight members 1650 shown in FIGS. 16A through 16C, additional weighting may be provided, e.g., by including a weighted material in or applying a weighted member to the end portions 1618*c* of arms 1618*a* and 1618*b* (and/or at other desired locations). This example feature is illustrated in FIGS. 16A and 16C by the weighted member 1640 mounted at the exterior sides of arm members 1618*a* and 1618*b* (e.g., rearward from the opening 1620 shown in FIG. 16A). While any desired type of weighting material or weighting member may be used without departing from this invention (including any of the various types described above), in at least some examples of this invention this weighting member 1640 may constitute a rubberized tungsten material that is engaged within a recess or opening provided in the arm 1618*a* and/or 1618*b* ("rubberized tungsten," as used herein, constitutes an elastomeric material (rubbers, thermoplastics, etc.) having tungsten (or tungsten oxide) dispersed in it, e.g., having a density of about 8 g/cc). In addition to allowing control over the weighting characteristics and increasing the putter head 1600 moment of inertia, the rubberized tungsten material can also function to perform some vibration dampening, e.g., as also discussed above.

As shown in FIGS. 16A through 16C, the top surfaces of the arms 1618*a* and 1618*b* also include alignment aids 1662 of the types described above in conjunction with FIG. 14A. Additional or other alignment aids, e.g., of the various types described above, also may be provided without departing from this invention.

Figure 17:
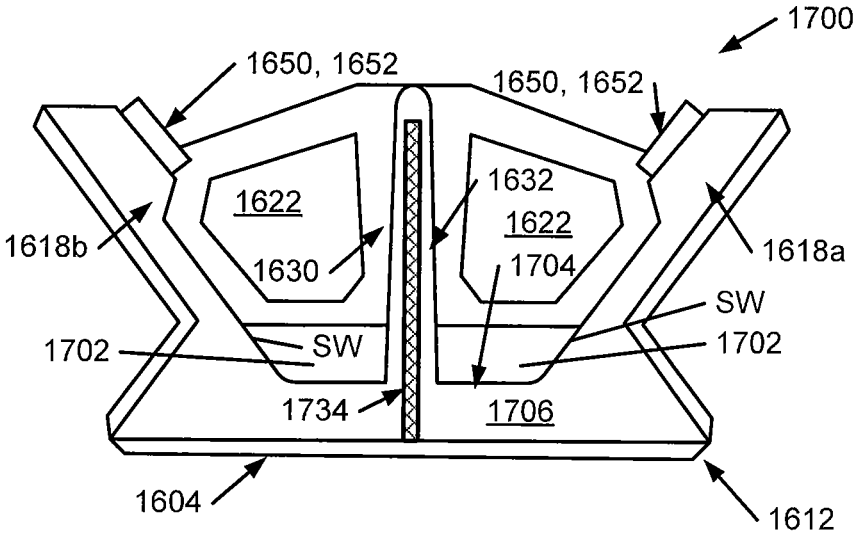

FIG. 17A provides an additional view of another example putter head 1700 of the type described above in conjunction with FIGS. 16A through 16C. This example putter head structure 1700 differs somewhat in structure and aesthetics from the example of FIGS. 16A through 16C, but the overall structure and appearance are similar. Similar reference numbers are used in FIG. 17 as compared with FIGS. 16A through 16C, and further detailed comment will be omitted. Optionally, as shown in this illustrated example, the front of the bottom base surface 1630 includes a polymeric vibration damping material 1702 (e.g., contacting or near the rear surface 1704 of the ball striking face 1604). The polymeric vibration damping material 1702, when present, may fill or substantially fill a vertical height differential of the putter head 1700 between the top surface 1706 of the ball striking face 1604 and the top surface of the base surface 1630 (e.g., in examples where the top of base surface 1630 lies below the top surface 1706 of the ball striking face 1604 when the putter is oriented at a ball address orientation). The polymeric material 1702 also may extend along and contact at least some portions of the interior (facing) side walls SW of arms 1618*a* and 1618*b*. Also, in the structure 1700 of FIG. 17, the central alignment aid 1734 is an elongated rectangle or line of contrasting color from other portions of the putter head 1700. This alignment aid 1734 may be raised or recessed, painted, etched, or otherwise provided on the central ridge element 1632.

Figure 18:
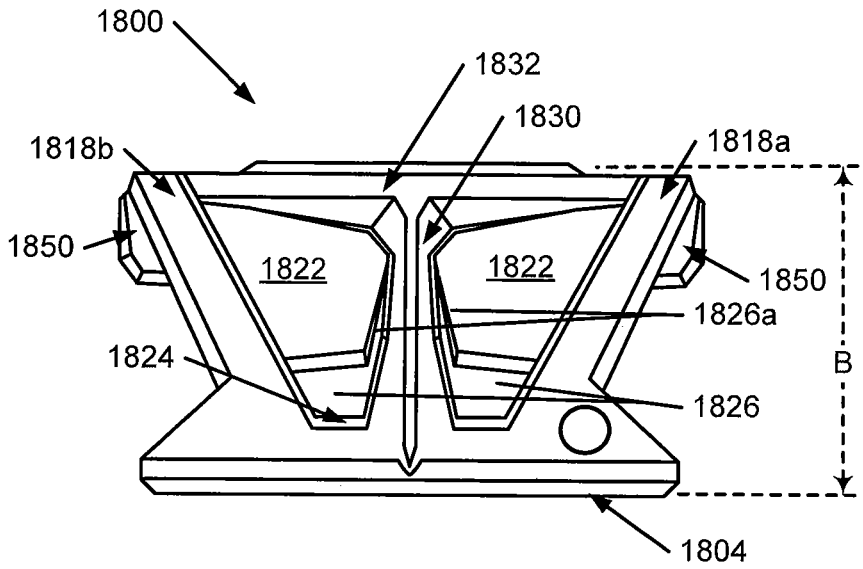

FIG. 18 illustrates another example putter head 1800 in accordance with some examples of this invention including side arms 1818*a* and 1818*b* and a central ridge 1830 that define two openings 1822 in the base surface of the putter head 1900. In this example structure 1800, the weights 1850 are mounted at the outside of the arms 1818*a* and 1818*b* (on non-facing side walls), although other arrangements are possible without departing from the invention (e.g., top, bottom, inside, end surface, etc.). Optionally, if desired, the weights 1850 may be provided as rubberized tungsten material engaged with the arms 1818*a* and 1818*b*, which may perform the dual function of providing weight at the rear, outer areas of the putter head 1800 (to thereby improve the club head's moment of inertia) and also potentially dampen vibrations.

Also, as shown in FIG. 18, one or both of the interior, forward surfaces of the openings 1822 (e.g., against the rear surface 1824 of the ball striking face 1804) may include a polymeric damping material 1826, e.g., to dampen vibrations from a ball strike. As shown in the example of FIG. 18, the damping material 1826 is relatively thick directly behind rear surface 1824 of the ball striking face 1804 with an extending damping finger portion 1826*a* extending rearward along the central ridge 1830. This finger 1826*a* may extend rearward at least to a position of 0.5B, where B is the overall front to back dimension of the overall club head 1800. In some examples, the finger 1826*a* will extend rearward from the ball striking face 1804 to a position at least 0.6B or even 0.75B. Notably, as shown in FIG. 18, the damping material 1826 also contacts and extends along a portion of the interior (facing) side walls of arms 1818*a* and 1818*b*.

Figure 19:
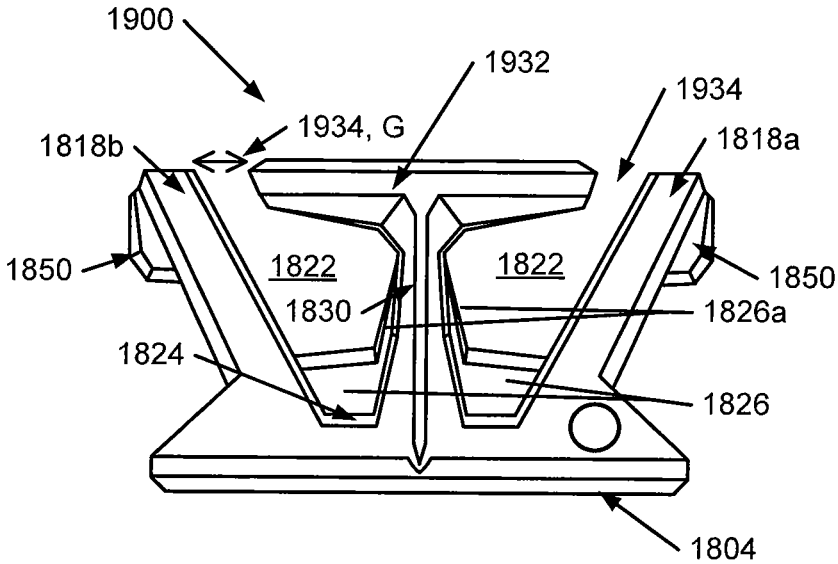

FIG. 18 shows that this example putter head structure 1800 includes a rear surface component 1832 that extends completely, the entire distance, between arm 1818*a* and 1818*b* (it may be integrally formed with the arms 1818*a* and 1818*b*, e.g., during molding casting, machining, or other manufacturing process, or it may be separate therefrom). This complete extension feature is not a requirement. Rather, FIG. 19 shows a putter head construction 1900 similar to that of FIG. 18 (with the same reference numbers being used for the same or similar parts), but in structure 1900 of FIG. 19, the rear surface component 1932 is separated from and unconnected to the arms 1818*a* (as shown by gaps 1934 at the free ends of the rear surface component 1932). This width of the gaps 1934 (i.e., distance G between the rear surface component 1932 and the arms 1818*a* and 1818*b*) may be the same or different on each side, and may range from 0.25 inches to 2.5 inches. The gap(s) 1932, when present, help reduce the overall weight of the putter body 1900 and allow more weight to be selectively positioned, e.g., at weighted areas 1850 (which allows one to increase and/or otherwise control club head moment of inertia, especially around a vertical axis).

Putters and putter heads may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

Conclusion

Of course, many modifications to the putter and putter head structures and/or methods for making these structures may be used without departing from the invention. For example, with respect to the structures, grips, aiming indicia or markings, other indicia or markings, different types of putter heads, various shaft curvatures and/or shapes, various shaft connecting member shapes, and/or other structural elements may be provided and/or modified in the structure without departing from the invention. With respect to the methods, additional production steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

The invention claimed is:

1. A putter head, comprising:

a main putter body portion including a first arm and a second arm;

a first polymeric element engaged with the first arm;

a second polymeric element engaged with the second arm;

a ball striking face member engaged with or integrally formed as part of the main putter body portion, the ball striking face member including a central portion for contacting a ball during a putting stroke, wherein the central portion includes a plurality of openings defined therein;

a polymeric material located between at least the central portion of the ball striking face member and the main putter body portion, wherein a portion of the polymeric material is exposed at an exterior surface of the ball striking face member through the plurality of openings; and wherein the first arm and the second arm extend rearward with respect to the ball striking face member and outward away from one another with respect to a geometric center of the ball striking face member.

2. A putter head according to claim 1, further comprising:

a first weight member engaged with the first arm; and a second weight member engaged with the second arm.

3. A putter head according to claim 2, wherein the first weight member is located proximate a free end of the first arm and the second weight member is located proximate a free end of the second arm.

4. A putter head according to claim 1, wherein a portion of the polymeric material is exposed at an upper surface of the putter head.

5. A putter head according to claim 1, wherein the ball striking face member is a plate member that is separate from and engaged with a front surface of the main putter body portion.

6. A putter head according to claim 5, wherein a portion of the polymeric material is exposed around a 360 degree perimeter of the putter head between the plate member and the main putter body portion.

7. A putter head according to claim 1, wherein the ball striking face member includes an insert element that is engaged within a recess provided in the main putter body portion.

8. A putter head according to claim 7, wherein the insert element includes a first layer made of a metal material and a second layer that constitutes the polymeric material.

9. A putter head according to claim 7, wherein the insert element includes a first layer made of a material having a first hardness and a second layer that constitutes the polymeric material, wherein the polymeric material has a second hardness that is lower than the first hardness.

10. A putter head according to claim 1, wherein the main putter body portion includes a surface extending between the first arm and the second arm.

11. A putter head according to claim 10, wherein the surface includes a first alignment aid thereon.

12. A putter head according to claim 1, wherein at least a portion of an exposed surface of the first polymeric element faces at least a portion of an exposed surface of the second polymeric element.

13. A putter head according to claim 1, wherein a ball striking surface of the ball striking face member has a loft angle of 3° or less.

14. A putter head according to claim 1, wherein an exposed ball striking surface at the central portion of the ball striking face member between a top and a bottom of the putter head includes the polymeric material and a metal material, and wherein a top-to-bottom cross section of the exposed ball striking surface at the central portion of the ball striking face has a structure that includes alternating polymeric material and metal material and a plurality of grooves including:

(a) a first groove defined in the exposed ball striking surface, wherein, in the cross section, a first edge of the first groove is defined by metal material and a second edge of the first groove opposite the first edge is defined by polymeric material;

(b) a second groove defined in the exposed ball striking surface closer to the top than the first groove, wherein, in the cross section, a first edge of the second groove is defined by metal material and a second edge of the second groove opposite the first edge is defined by polymeric material; and (c) a third groove defined in the exposed ball striking surface closer to the top than the second groove, wherein, in the cross section, a first edge of the third groove is defined by metal material and a second edge of the third groove opposite the first edge is defined by polymeric material.

15. A putter head according to claim 1, wherein the plurality of openings includes a plurality of independent and separated openings defined in the ball striking face member, wherein at least some of the independent and separated openings extend across the central portion of the ball striking face member, wherein a material making up the ball striking face member between adjacent openings and the polymeric material exposed in at least some of the openings extend across the central portion of the ball striking face member, and wherein a plurality of grooves are defined in the ball striking surface of the putter head, wherein the plurality of grooves extend across the central portion of the ball striking face member and are formed in at least one of: (a) the material making up the ball striking face member between adjacent openings and (b) the polymeric material exposed in the openings in the ball striking face member.

16. A putter head according to claim 15, wherein at least some of the plurality of grooves are defined in the material making up the ball striking face member.

17. A putter head according to claim 15, wherein at least some of the plurality of grooves are defined in the polymeric material exposed in at least some of the openings in the ball striking face member.

18. A putter head according to claim 15, wherein the plurality of grooves are defined both in the material making up the ball striking face member and in the polymeric material exposed in at least some of the openings in the ball striking face member.

19. A putter head according to claim 1, wherein the plurality of openings includes a first elongated opening defined in the ball striking face member and extending across the central portion of the ball striking face member, wherein a first groove is defined in a ball striking surface of the putter head and is formed such that a material making up the central portion of the ball striking face member forms a first edge of the first groove and the polymeric material exposed in the first elongated opening forms a second edge of the first groove located opposite the first edge.

20. A putter head according to claim 19, wherein the first groove is defined in the material making up the ball striking face member.

21. A putter head according to claim 19, wherein the first groove is defined in the polymeric material exposed in the first elongated opening.

22. A putter head according to claim 19, wherein the first groove is defined both in the material making up the ball striking face member and in the polymeric material exposed in the first elongated opening.

23. A putter head according to claim 1, wherein the first polymeric element and the second polymeric element constitute opposite sides of a single polymeric member mounted on the main putter body portion.

* * * * *